US007384722B2

(12) United States Patent
Ohtani et al.

(10) Patent No.: US 7,384,722 B2
(45) Date of Patent: Jun. 10, 2008

(54) METHOD FOR PREPARING FUNCTIONAL PARTICULATE ORGANIC MATERIAL, TONER USING THE FUNCTIONAL PARTICULATE ORGANIC MATERIAL, AND IMAGE FORMING METHOD AND APPARATUS USING THE TONER

(75) Inventors: Shinji Ohtani, Suntoh-gun (JP); Hiroshi Yamashita, Numazu (JP); Yohichiroh Watanabe, Fuji (JP); Tsunemi Sugiyama, Yokohama (JP); Takuya Saito, Numazu (JP)

(73) Assignee: Ricoh Company Limited, Tokyo (JP)

( * ) Notice: Subject to any disclaimer, the term of this patent is extended or adjusted under 35 U.S.C. 154(b) by 543 days.

(21) Appl. No.: 10/871,580

(22) Filed: Jun. 21, 2004

(65) Prior Publication Data

US 2004/0259013 A1 Dec. 23, 2004

(30) Foreign Application Priority Data

Jun. 23, 2003 (JP) ..... 2003-178465
Dec. 5, 2003 (JP) ..... 2003-406818
Dec. 5, 2003 (JP) ..... 2003-406821

(51) Int. Cl.
*G03G 9/087* (2006.01)
*G03G 15/10* (2006.01)

(52) U.S. Cl. ..... 430/109.4; 430/109.1; 430/137.1; 430/108.1; 430/110.2; 430/110.3; 430/108.3; 430/108.4

(58) Field of Classification Search ..... 430/109.4, 430/109.1, 45.1, 137.1, 57.1, 108.1, 110.2, 430/110.3, 108.3, 108.4
See application file for complete search history.

(56) References Cited

U.S. PATENT DOCUMENTS 5,066,559 A * 11/1991 Elmasry et al. ..... 430/115
5,258,255 A 11/1993 Shimizu et al.
5,314,777 A 5/1994 Watanabe et al.
5,368,972 A 11/1994 Yamashita et al. ..... 430/137.11
5,418,103 A 5/1995 Muto et al. ..... 430/108.15
5,541,031 A 7/1996 Yamashita et al.
5,576,393 A 11/1996 Yamashita et al. ..... 525/293
5,827,633 A 10/1998 Ong et al. ..... 430/137
5,962,176 A 10/1999 Ohno et al. ..... 430/109
5,976,749 A 11/1999 Sukata et al.
5,990,332 A 11/1999 Sukata et al.
6,140,000 A 10/2000 Yamashita ..... 430/108.2
6,285,848 B1 9/2001 Aita et al.
6,503,676 B2 1/2003 Yamashita et al. ..... 430/108.3
6,740,460 B2 5/2004 Tomita et al. ..... 430/109.4
6,770,411 B2 8/2004 Masuda et al.
6,787,280 B2 9/2004 Yamashita et al.
6,846,604 B2 1/2005 Emoto et al.
2004/0259013 A1 12/2004 Ohtani et al.

FOREIGN PATENT DOCUMENTS

CN 1179248 C 12/2004
CN 1190712 C 2/2005
EP 0 390 527 A2 10/1990
EP 0 618 511 A1 10/1994
JP 55-42752 3/1980
JP 5-27479 2/1993
JP 5-204182 8/1993
JP 5-249732 9/1993
JP 6-3856 1/1994
JP 6-214422 8/1994
JP 7-152202 6/1995
JP 8-15894 1/1996
JP 8-160657 6/1996
JP 9-124659 5/1997
JP 10-90946 4/1998
JP 10-130546 5/1998
JP 11-65281 3/1999
JP 11-84726 3/1999
JP 11-149179 6/1999
JP 11-237765 8/1999
JP 11-237767 8/1999
JP 2001-13709 1/2001

(Continued)

OTHER PUBLICATIONS

U.S. Appl. No. 11/376,286, filed Mar. 16, 2006, Ohtani.

(Continued)

*Primary Examiner*—Mark F. Huff
*Assistant Examiner*—Rachel L Burney
(74) *Attorney, Agent, or Firm*—Oblon, Spivak, McClelland, Maier & Neustadt, P.C.

(57) ABSTRACT

A method for preparing a functional particulate organic material, including providing a suspension of a particulate organic material having an acid group on a surface thereof; reacting a metal cation with tri- or more-valence with the acid group; and reacting at least one of an organic acid and an organic acid salt with the metal cation. A toner prepared by the method mentioned above. An image forming method including developing a latent image with the toner; transferring the toner image on a receiving material optionally via an intermediate transfer medium, and fixing the toner image on the receiving material. A process cartridge including a developer container containing a developer including the toner mentioned above, and at least one of an image bearing member; a charger; a developing device; and a cleaner.

19 Claims, 3 Drawing Sheets

FOREIGN PATENT DOCUMENTS

| | | |
|---|---|---|
| JP | 2001-343786 | 12/2001 |
| JP | 2001-343787 | 12/2001 |
| JP | 2002-82484 | 3/2002 |
| JP | 2002-296843 | 10/2002 |
| JP | 2002-341615 | 11/2002 |
| JP | 2003-91100 | 3/2003 |
| JP | 2003-202700 | 7/2003 |
| JP | 2003-228196 | 8/2003 |
| JP | 2003-280272 | 10/2003 |

OTHER PUBLICATIONS

US. Appl. No. 11/513,175, filed Aug. 31, 2006, Ohki et al.
U.S. Appl. No. 11/519,893, filed Sep. 13, 2006, Inoue et al.
U.S. Appl. No. 11/734,895, filed Apr. 13, 2007, Yamashita et al.
U.S. Appl. No. 11/851,475, filed Sep. 7, 2007, Watanabe et al.
U.S. Appl. No. 11/868,618, filed Oct. 8, 2007, Sugiyama et al.

* cited by examiner

METHOD FOR PREPARING FUNCTIONAL PARTICULATE ORGANIC MATERIAL, TONER USING THE FUNCTIONAL PARTICULATE ORGANIC MATERIAL, AND IMAGE FORMING METHOD AND APPARATUS USING THE TONER

BACKGROUND OF THE INVENTION

1. Field of the Invention

The present invention relates to a method for preparing a functional particulate organic material for use in toners used for developing an electrostatic latent image formed by an image forming method such as electrophotography, electrostatic recording and electrostatic printing; paints, colorants, fluidity improving agents, spacers, preservation stabilizers, cosmetics, and fluorescent labels. In addition, the present invention also relates to a toner using the functional particulate organic material. Further, the present invention relates to an image forming method and an image forming apparatus (including a process cartridge) using the toner.

2. Discussion of the Background

Particulate organic materials have been used for various fields. For example, particulate organic materials can be used as toners and developers for use in electrophotographic image forming fields. In addition, particulate organic materials can also be used as fluidity improving agents, charge controlling agents, carriers and photoconductive powders, and intermediate materials therefor.

Electrophotographic developer is used for image forming methods such as electrophotography, electrostatic recording and electrostatic printing, which typically include the following processes:

(1) an electrostatic latent image formed on an image bearing member such as photoreceptors is developed with a developer including a toner to form a toner image on the image bearing member (developing process);

(2) the toner image is transferred on a receiving material such as receiving papers (transfer process); and (3) the toner image is fixed on the receiving material upon application of heat and/or pressure, or the like (fixing process).

Dry developers are broadly classified into two-component developers which are typically constituted of a dry toner and a carrier, and magnetic or non-magnetic one-component developers which are typically constituted of a toner and which do not include a carrier.

Electrophotographic dry toners for which particulate organic materials are used are typically prepared by the following manufacturing method:

(1) a toner constituent mixture including a colorant, a binder resin (e.g., styrene resins and polyester resins) and optional additive is kneaded upon application of heat thereto (kneading process); and (2) after being cooled, the kneaded mixture is pulverized to prepare toner particles.

It is attempted to decrease the particle diameter of toner in order to produce high quality toner images. The toner particles prepared by the pulverization method mentioned above have irregular forms, and therefore the toner particles can be further pulverized in image forming apparatus due to stresses applied to the toner particles by developing rollers, toner supplying rollers, toner layer thickness controlling blades and frictional charge applying blades of the image forming apparatus. As a result, super fine toner particles are produced and/or a fluidity improving agent located on the surface of the toner particles is embedded into the toner particles, resulting in deterioration of image qualities.

In addition, since the pulverized toners have irregular forms, the toners have poor fluidity and therefore a large amount of fluidity improving agent has to be included therein. Further, the toners have low packing ability (i.e., the amount of a toner contained in a container is relatively small), and thereby the toner bottle becomes large in size. Therefore, it becomes difficult to design a compact image forming apparatus. Namely, the advantage of the toner (i.e., small particle diameter) is not effectively exploited. Further, when a toner is prepared by a pulverization method, the particle diameter of the toner is limited (namely a toner having a very small particle diameter cannot be produced by a pulverization method).

Recently, color images are popularly produced in offices. Color image forming apparatus have a complex structure and use a complex image transfer device because plural toner images have to be transferred on proper positions of a receiving material. When a pulverized toner is used for such color image forming apparatus, a problem such that the transferred toner images have omissions due to poor transferability of the toner used occurs. In attempting to avoid this problem by increasing the amount of toner adhered to the electrostatic latent images, another problem in that the toner consumption increases occurs.

Therefore a need exists for enhancement of toner image transfer efficiency, which results in production of high quality images and reduction of toner consumption (i.e., reduction of running costs). When a toner having an excellent transfer efficiency is used, it becomes unnecessary to use a cleaning device, and thereby the image forming apparatus can be miniaturized and the manufacturing costs of the apparatus can be reduced. In addition, the image forming apparatus produces no waste toner. In attempting to solve the problems specific to the toners having irregular forms, various spherical toners and various methods for producing spherical toners have been proposed.

For example, suspension polymerization methods and emulsion polymerization/aggregation methods in which particles are prepared by emulsion polymerization, followed by aggregation of the emulsified particles have been investigated. In addition, polymer solution emulsifying methods which utilize a technique of reducing the volume of toner particles have been proposed. Specifically, the methods include the following steps:

(1) a toner constituent is dissolved or dispersed in a volatile solvent such as organic solvents having a low boiling point;

(2) the solution or dispersion is dispersed in an aqueous medium including a dispersant to form an emulsion; and (3) the volatile solvent is removed from the emulsion to prepare a dispersion including toner particles.

This method is disclosed in, for example, published unexamined Japanese Patent Application No. (hereinafter JP-A) 07-152202.

This method has the following advantages over the suspension polymerization methods and emulsion polymerization/aggregation methods:

(1) a variety of resins can be used as the binder resin of the toner; and (2) particularly, polyester resins which are suitable for toners for full color image forming because the resins have good transparency and the resultant toner images have smooth surface can be used as the binder resin.

However, the method has a drawback in that the dispersant used strongly adheres to the surface of the resultant toner particles to such an extent as not to be removed therefrom even when the toner particles are subjected to a washing treatment, and thereby the charge properties of the toner greatly depend on the properties of the dispersant used. Namely, the resultant toner particles have low charge quantity and low charge rising speed, while the charge properties seriously change depending on the environmental humidity.

A modified polymer solution emulsion method is disclosed in JP-A 11-149179 in which a low molecular weight resin is used to reduce the viscosity of the polymer solution or dispersion, to easily perform the emulsification, and the low molecular weight resin is then polymerized in the particles of the emulsion to improve the fixability of the resultant toner. In this method, the functional groups of the resin to be polymerized and the groups of a compound to be reacted with the resin largely influence the charge properties of the resultant toner particles. In particular, when an isocyanate compound is used to be reacted with the resin, the charge properties of the resultant toner change depending on the charge properties of the resultant urea bonding or urethane bonding of the reaction product (i.e., the polymerized resin).

In order to modify the property of the surface of a particulate organic material, mechanical methods such as hybridization and mechano-fusion methods, chemical methods using a coupling agent such as silane coupling agents and titanium coupling agents and the methods disclosed in JP-As 2001-343786 and 11-84726 have been proposed.

The mechanical methods such as hybridization and mechano-fusion methods can produce considerable modification effect, but the particulate organic material to be treated receives large impact force and heat energy. In general, particulate organic materials cause a morphologic alteration. Therefore, when such mechanical methods are used, the desired function can be imparted to the material but other properties of the resultant toner tend to seriously change. Specifically, when the impact force and heat energy applied to the toner particles is reduced so that the material does not cause morphologic alteration, the effect of the surface modification is weakened. In contrast, when the impact force and heat energy is increased to sufficiently perform the surface modification, the organic material causes morphologic alteration. In addition, the apparatus used for the mechanical methods are large in size and expensive, and thereby the manufacturing costs of the toner are increased.

The chemical surface modification methods typically use a coupling agent such as silane coupling agents and titanium coupling agents. JP-As 2001-343786 and 11-84726 have disclosed such chemical methods. However, it is hard for the methods to impart a desired property to a particulate organic material. In particular, there are narrow options for the coupling agents.

Specifically, JP-A 2001-343786 discloses the following method:

(1) a metal compound of an aromatic oxycarboxylic acid, a colorant, a material having a low softening point and a polar resin are dispersed in a monomer;
(2) the mixture is polymerized in an aqueous medium to produce a particulate organic material while the pH of the system is controlled so as to be from 4.5 to 9.0 by adding a metal compound of an aromatic oxycarboxylic acid which can be dissolved in an aqueous alkali solution with pH of from 9 to 13 (first polymerization process);
(3) the polymerization is continued while the pH of the system is adjusted so as to be 9 to 13 (second polymerization process); and
(4) the reaction product in the dispersion is treated with an acid treatment using an acid with pH of from 1.0 to 2.5 to deposit the metal compound of the aromatic oxycarboxylic acid on the surface of the particulate organic material.

However, the metal compound is present on the surface of the resultant particulate material while released from the surface, namely, the surface modifying agent is not fixed on the surface of the particulate material.

JP-A 11-84726 discloses the following surface modification method:

(1) an aqueous solution of boric acid or a metal salt thereof is added to a coagulated emulsion including a colorant at a temperature in the range of from about 30 to about 95° C.; and
(2) the pH of the resultant reaction mixture is controlled so as to be from about 9 to 12 by adding a base followed by addition of salicylic acid or catechol thereto to chemically modify the surface of aggregated particles of the emulsion.

However, only zinc is exemplified as the metal of the metal salt in JP-A 11-84726, and the reaction temperature is relatively high (85° C.). Since the zinc of zinc sulfate described in JP-A 11-84726 is divalent, the zinc ion makes a coordinate bond while having four coordinate valence. Therefore, only one molecule of salicylic acid or catechol can be bonded to the zinc ion. As a result of the present inventors' study, it is found that when a divalent metal such as Zn is used, i.e., only one molecule of an organic acid is bonded thereto, the surface modification effect cannot be produced. In addition, since salicylic acid is added to the reaction mixture at an alkali region (i.e., at a pH of from 9 to 12), the reaction has to be performed at a high temperature in the range of from 30 to 95° C. In addition, the pH is maintained until the reaction is completed, and thereby a problem in that the metal compound is not perfectly reacted occurs. The reaction is performed at a high temperature (85° C.) in Example in JP-A 11-84726, the reaction product causes serious morphologic alteration, which is a big problem.

Namely, when this technique is applied to a toner having a low glass transition temperature to improve the low temperature fixability, a problem which occurs is that it becomes impossible to perform the reaction or it takes long time until the reaction is completed if the reaction temperature is relatively low.

Because of these reasons, a need exists for a simple surface treatment method by which a variety of surface modifying agents can be firmly fixed on the surface of organic particles to impart a desired function to the particles without causing problems such as morphologic alteration due to heat and mechanical shock.

SUMMARY OF THE INVENTION

Accordingly, an object of the present invention is to provide a method for preparing a functional particulate organic material, by which a surface modifying agent can be firmly fixed on the surface of organic material to impart a desired function to the particulate organic material without causing problems such as morphologic alteration of the organic material due to heat and mechanical shock.

Another object of the present invention is to provide a toner which can maintain good charge properties even when the toner is used for a long period of time and environmental conditions change.

Yet another object of the present invention is to provide an image forming method and apparatus (such as process cartridge) by which high quality color images can be produced for a long period of time even when environmental conditions change.

Briefly these objects and other objects of the present invention as hereinafter will become more readily apparent can be attained by a method for preparing a functional particulate organic material, which includes the following steps:

providing a suspension of a particulate organic material having an acid group on a surface thereof;

first reacting a metal cation with tri- or more-valence with the acid group; and second reacting an organic acid or an organic acid salt with the metal cation.

The suspension providing step can include the following steps:

dissolving or dispersing an organic material composition including at least a resin and a colorant in a polymerizable monomer to prepare an organic material composition liquid;

dispersing the organic material composition liquid in an aqueous medium comprising a surfactant to prepare an emulsion; and polymerizing the emulsion to prepare the suspension.

Alternatively, the suspension providing step can include the following steps:

dispersing an organic material composition including at least a resin and a colorant in an aqueous medium including a surfactant to prepare an organic material composition liquid;

aggregating particles in the organic material composition liquid; and heating the aggregated particles to fuse the aggregated particles in the aqueous medium to prepare the suspension.

Alternatively, the suspension providing step can include the following steps:

dissolving or dispersing an organic material composition including at least a resin and a colorant in an organic solvent to prepare an organic material composition liquid;

dispersing the organic material composition liquid in an aqueous medium including a surfactant to prepare an emulsion; and removing the organic solvent from the emulsion to prepare the suspension.

Alternatively, the suspension providing step can include the following steps:

dissolving or dispersing an organic material composition including at least a resin and a colorant in an organic solvent to prepare an organic material composition liquid;

dispersing the organic material composition liquid in an aqueous medium including a surfactant to prepare an emulsion;

subjecting the organic material composition liquid to an addition polymerization reaction; and removing the organic solvent from the organic material composition liquid during or after the addition polymerization reaction to prepare the suspension.

The resin preferably has an isocyanate group at an end portion thereof.

The metal cation is preferably a cation of a metal selected from the group consisting of Fe, Al, Cr, Co, Ga, Zr, Si and Ti.

The organic acid is preferably a compound having one of the following formulae (1), (2) and (3):

(1)

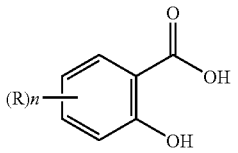

wherein n is an integer of form 1 to 4; and R represents an alkyl group having from 1 to 12 carbon atoms, an aryl group, a perfluoroalkyl group, a nitro group, a halogen group or an amino group, wherein when n is 2 or more, each of R can be the same as or different from the others;

(2)

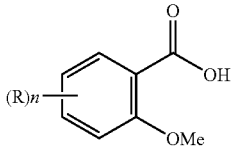

wherein n is an integer of form 1 to 4; and R represents an alkyl group having from 1 to 12 carbon atoms, an aryl group, a perfluoroalkyl group, a nitro group, a halogen group or an amino group, wherein when n is 2 or more, each of R can be the same as or different from the others; and (3)

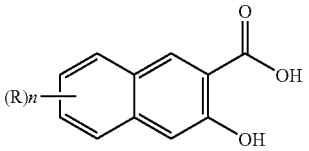

wherein n is an integer of form 1 to 4; and R represents an alkyl group having from 1 to 12 carbon atoms, an aryl group, a perfluoroalkyl group, a nitro group, a halogen group or an amino group, wherein when n is 2 or more, each of R can be the same as or different from the others.

The organic acid salt is preferably a salt of a metal selected from the group consisting of Na, K and Li.

The method preferably includes at least one of the following steps:

heating the suspension after the second reacting step; and adding a fluorine-containing surfactant to the suspension after the second reacting step.

The fluorine-containing surfactant is preferably a compound having the following formula (4):

(4)

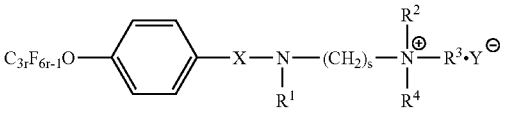

wherein X represents —$SO_2$, or —CO—; Y represents I or Br; $R^1$, $R^2$, $R^3$ and $R^4$ independently represent a hydrogen atom, an alkyl group having 1 to 10 carbon atoms or an aryl group; and each of r and s is an integer of from 1 to 20.

It is preferable that the method further includes at least one of the following steps:

adding a charge controlling agent to the suspension after the second reacting step.

adding a second particulate organic material having a volume-average particle diameter of form 0.01 μm to 1.0 μm to the suspension after the second reacting step.

It is preferable that the organic acid and the organic acid salt has two or more reaction groups, one of which is reacted with the metal cation, and the method further includes the following steps:

third reacting a second metal cation, which is the same as or different from the first-mentioned metal cation, with another one of the two or more reaction groups of the organic acid or organic acid salt so that the organic acid or organic acid salt serves as a crosslinking ligand; and fourthly reacting a second organic acid or a second organic acid salt, which are the same as or different from the first-mentioned organic acid or organic acid salt, respectively, with the second metal cation.

As another aspect of the present invention, a particulate organic material prepared by one of the above-mentioned methods is provided. The particulate organic material can be preferably used as toner particles. In this case, the suspension is dried after the reactions to prepare the toner particles; and a fluidity improving agent is mixed with the toner particles to prepare the toner.

When the particulate organic material is used as a toner, the binder resin preferably includes a polyester resin in an amount of from 50 to 100% by weight based on total weight of the binder resin.

Yet another aspect of the present invention, an image forming method is provided which includes:

developing an electrostatic latent image on at least one image bearing member with at least one color toner to form at least one color toner image on the at least one image bearing member;

transferring the at least one toner image on a receiving material; and fixing the at least one toner image on the receiving material, wherein the at least one toner is the toner mentioned above.

The toner image can be transferred to a receiving material via an intermediate transfer medium. In this case, an electric field is preferably applied to the intermediate transfer medium when the toner image is transferred to the intermediate transfer medium.

In the image forming method a plurality of image bearing members and respective plural color toners can be used to form a plurality of color toner images on the respective image bearing members.

A further aspect of the present invention, a process cartridge is provided which includes:

a developer container containing a developer including the toner mentioned above; and at least one of an image bearing member;

a charger configured to charge the image bearing member to form an electrostatic latent image thereon;

a developing device configured to develop the electrostatic latent image with the developer to form a toner image on the image bearing member; and a cleaner configured to clean a surface of the image bearing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
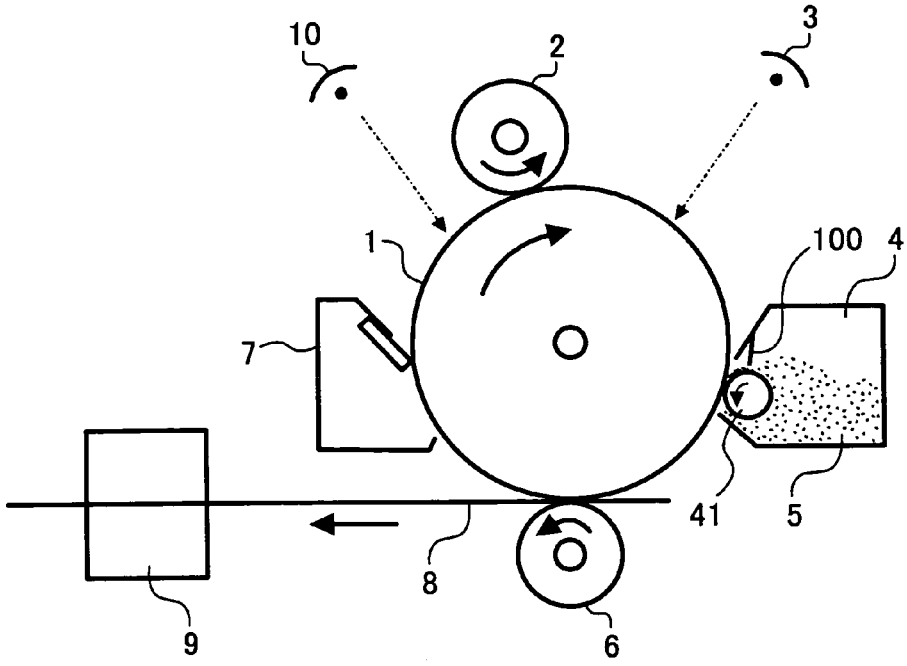
FIG. 1 is a schematic view illustrating an image forming apparatus for use in the image forming method of the present invention.

The abstract of the method of the present invention for preparing a functional particulate organic material in an aqueous medium will be explained. However, the present invention is not limited thereto.

At first, a proper amount of an alkali (such as sodium hydroxide aqueous solutions) is dropped into a slurry, which is prepared by dispersing a particulate organic material (such as polymers), which has been prepared, for example, by one of the methods mentioned below, in water at a temperature of from 5 to 30° C. After the mixture is agitated, an aqueous solution including a metal cation having three or more valences is dropped into the mixture. The mixture is agitated at room temperature.

In this case, when an organic acid group such as carboxyl groups is present on the particulate organic material, the acid (carboxyl) group is changed to a sodium alkoxide due to the addition of sodium hydroxide. In addition, by adding the metal cation, a metal salt can be formed. It is very effective to previously add an alkali because the metal salt can be easily produced at a relatively low temperature.

On the other hand, an organic acid having two or more reaction groups, such as 3,5-di-tert-butylsalicylic acid, is mixed with an alkali (such as sodium hydroxide) to prepare a salt of the salicylic acid. The salt is added to the slurry prepared above, which includes particulate organic material including a metal salt of the organic acid group (such as carboxyl group) on a portion of the surface thereof. In this case, the salt of the salicylic acid rapidly reacts with the metal alkoxide on the surface of the particulate organic material at room temperature (from 5° C. to 30° C.), resulting in formation of a metal compound which is bonded to the surface of the particulate organic material (such as polymers).

At this point, the pH of the dispersion is from 4 to 6 (i.e., the dispersion is acidic). When the dispersion is alkaline, the reaction is not completed. In addition, by changing the molar ratio of the metal cation to the organic acid (such as salicylic acid), the charge property controlling effect of the resultant particulate organic material can be widely changed.

The acid group (carboxyl group) present on the surface of the organic material is a monovalent anionic group. Even when a metal cation with tri- or more-valence is reacted with the acid group, the metal is still charged positively and has charges corresponding to a cation with di- or more-valence. Therefore, counter anions are present in the vicinity of the metal cation. In this case, when an organic acid or salt thereof is added thereto, the organic acid or salt thereof can be rapidly bonded with the organic material by causing an ion exchanging reaction with the metal cation.

In this regard, the reaction is not performed under a condition such that the metal cation is already neutralized by the acid groups present on the surface of the organic material. Specifically, in a case where the tri- or more-valent metal cation is neutralized by three or more acid groups present on the surface of the organic material, the reaction cannot be performed. However, it is difficult that the three or more acid groups are bonded to the metal cation due to steric hindrance. Therefore, the metal cation can be reacted with the added organic acid or salt thereof. Thus, the system achieves an equilibrium state over 1 to 3 hours.

When it is desired to further react a second metal with the organic acid or salt thereof after the first reaction mentioned above, the organic acid or salt thereof is excessively added. This is because if the organic acid is added in such an amount that all the reactive portions of the organic acid react with the metal cation, the reaction does not proceed any more. Specifically, the molar ratio of the organic acid (or salt thereof) to the metal cation added at the first stage is preferably $n(V-1)$ wherein n is a number of about 2 or more, and V represents the valence of the metal cation. In this case, one of the reactive groups of the organic acid reacts with the metal cation. Therefore, other reaction portions of the organic acid can be reacted with a second metal cation.

The average particle diameter of the particulate organic material is generally from 0.1 to 100 μm, and preferably from 1 to 30 μm.

By adding a second metal cation with di- or more-valence to the reaction product obtained at the first stage so that the second metal cation is reacted with the other reactive groups of the organic acid or metal salt thereof. Further, a second organic acid which may be the same as or different from the organic acid used at the first stage, such as sodium salt of benzylic acid, is reacted with the second metal cation. Thus, a polynuclear metal complex compound or a polynuclear metal complex salt, which has two or more metal ions and two or more organic acids in a molecule, can be provided on the surface of the organic material. Namely, in the complex compound, the organic acid having two or more reactive groups therein serves as a crosslinking ligand.

When such a polynuclear metal complex compound (or salt) is provided on the surface of the particulate organic material, the function imparting effect can be dramatically enhanced compared to a case where a complex compound having one core is formed. This reason is considered to be that multiple layers of the complex compound are bulkily formed on the surface of the organic material. The surface on which the complex compound is formed is very strong and is uniform in quality. In addition, by performing such a surface treatment in plural times, different functions can be freely imparted to the particulate organic material.

By using the method of the present invention, the flexibility in surface-treating particulate organic materials can be enhanced, and thereby desired functional organic particles can be easily provided. For example, by using the above-mentioned method, a polynuclear aluminum complex compound (or salt) which includes 3,5-di-tert-butylsalicylic acid and benzylic acid as ligands is formed on the surface of the particulate organic material. When this material is used for an electrophotographic toner, the resultant toner has both a good charge rising property, which can be imparted to the toner by the aluminum salt of benzylic acid, and a good charge stability, which can be imparted to the toner by the aluminum salt of 3,5-di-tert-butylsalicylic acid.

In addition, the functional organic molecules formed on the particulate material by the method mentioned above have a highly-oriented multi-layer structure. Therefore, even when the mount of the functional organic molecules is so small as to be from 0.01 to 1.0 part by weight per 100 parts by weight of the particulate organic material to be treated, good characteristics can be imparted to the particulate organic material (toner). In addition, by changing the amount of the polar groups present on the surface of the source organic material and/or the use amount of the surface modifying agent, the treatment degree can be widely changed. Thus, particulate organic materials having the desired properties can be easily provided. Namely, when it is desired to impart a desired property to a material by the surface treatment method mentioned above, there are many options therefor.

The reason why the good effect cannot be produced when the metal cation used at the first stage is divalent and therefore a metal cation with tri- or more-valence is used therefor is considered to be that the coordinate abilities of the metal ions are different. Specifically, when a divalent metal cation is used at the first stage, only one molecule of an organic acid can be bonded with the metal cation because the other side of the divalent is bonded with the polymer of the particulate organic material. In contrast, when a tri- or more-valent metal cation is used, two or more molecules of an organic acid can be bonded with the metal cation. When two or more molecules are bonded with the metal cation, good charge controlling effect can be produced. By further adding a second metal cation with di- or more-valence, which is the same or different from the first metal cation, to the dispersion including the particulate organic material, the second metal cation can be bonded with the free acid group of the organic acid. Furthermore, by adding a second organic acid, which is the same as or different from the organic acid added at the first stage, to the dispersion, the second organic acid is bonded to the second metal cation. Thus, the complex compound can be formed on the surface of the particulate organic material.

As mentioned above, when such a polynuclear complex compound (or salt) is formed on a particulate material, the function imparting effect can be dramatically enhanced compared to a case where a complex compound having one core is formed. This is because multiple layers of the complex compound are bulkily formed on the surface of the organic material. When such a bulky layer is formed on a toner, the probability of contact of the particulate organic material (toner) with the carrier used increases, thereby enhancing the charge rising property of the developer. In addition, there is a case where the tri- or more-valent metal cation used at the first stage deteriorates the environmental stability of the toner. In this case, when a second metal cation different from the first metal cation is reacted at the second stage, it becomes possible to impart good environmental stability to the resultant toner. The thus prepared functional organic molecules can produce an excellent charge controlling effect.

When a toner is prepared by a known pulverization method, a predetermined amount of charge controlling agent has to be present on the surface of the resultant toner particles, to impart good charge properties to the resultant toner. Therefore, at least 0.5 parts by weight (in general, one part by weight) of charge controlling agent has to be added to 100 parts by weight of the toner. In particular, colorless charge controlling agents, which are typically used for color toners, have poor charge imparting ability, and therefore the added amount of the charge controlling agents is typically 2 or more parts by weight per 100 parts by weight of the toner.

However, when the surface treatment method mentioned above is used, the desired charge properties can be imparted to the particulate organic material (toner) even when the amount of the functional organic molecules is from 0.1 to 0.3 parts by weight. This is because the functional organic molecules is selectively present on the surface of the toner while being highly-oriented.

The charge quantity can be freely changed by changing the amount of the organic metal compound formed on the toner, and therefore a toner having charge properties suitable for targeted image forming system can be easily provided. The amount of the charge controlling component (i.e., the organic metal compound) is not particularly limited, but is generally from 0.03 to 1.0% by weight, preferably from 0.05 to 0.5% by weight, and more preferably from 0.1 to 0.3%, based on the total weight of the toner.

Since a charge controlling component is selectively formed on the surface of the particle organic material (toner), the resultant toner has good charge rising property. In addition, since one side of the charge controlling component is fixed on the toner, the toner does not cause a contamination problem in that frictional charging member such as carrier is contaminated by a charge controlling agent, which problem is caused by conventional toners using an organic low molecular weight material as a charge controlling agent. Therefore, the toner does not cause problems even when used for a long period of time.

Suitable materials for use as the metal cation with tri- or more-valence which is used for the surface treatment include cations of metals such as Fe, Al, Cr, Co, Ga, Zr, Si and Ti.

In addition, suitable materials for use as the organic acid and organic acid salt which are used for the surface treatment include compounds having the following formulae (1) to (3):

(1)

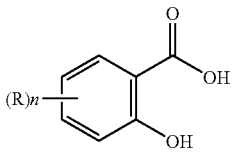

wherein n is an integer of form 1 to 4; and R represents an alkyl group having from 1 to 12 carbon atoms, an aryl group, a perfluoroalkyl group, a nitro group, a halogen group or an amino group, wherein when n is 2 or more, each of R can be the same as or different from the others;

(2)

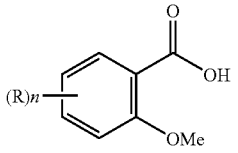

wherein n is an integer of form 1 to 4; and R represents an alkyl group having from 1 to 12 carbon atoms, an aryl group, a perfluoroalkyl group, a nitro group, a halogen group or an amino group, wherein when n is 2 or more, each of R can be the same as or different from the others; and (3)

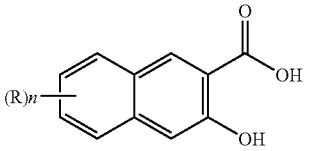

wherein n is an integer of form 1 to 4; and R represents an alkyl group having from 1 to 12 carbon atoms, an aryl group, a perfluoroalkyl group, a nitro group, a halogen group or an amino group, wherein when n is 2 or more, each of R can be the same as or different from the others.

It is found that when the thus prepared toner is used for image forming methods, particularly full color image forming methods in which full color images are formed by repeating a developing operation and a transferring operation using a single photoreceptor, or by forming respective color images on the respective photoreceptors using the respective developing devices, followed by transferring the respective color images, high quality color images can be produced. In addition, even when an intermediate transfer medium is used to avoid misalignment of color images, the toner does not cause problems in that image quality deteriorates due to increase of the amount of residual toner on the photoreceptors and the intermediate transfer medium.

The particles prepared by the above-mentioned method can be used not only for toner particles, but also for fluidity improving agents, charge controlling agents, carriers and photoconductive powders, which can be used for electrophotographic image forming members and developers. In addition, the particles can also be used for paints, colorants, general-use fluidity improving agents, spacers, preservation improving agents, cosmetics, fluorescent labels or the like materials.

Then the toner of the present invention will be explained in detain.

The particulate organic material for use in the toner can be prepared by the following methods.

Suspension Polymerization Methods

At first, a colorant, a release agent and optional additives are dispersed in a mixture of one or more monomers and an oil-soluble initiator. The mixture is emulsified in an aqueous medium including a surfactant, a solid dispersant, etc. using one of the below-mentioned emulsifying methods. Then, the emulsion is subjected to polymerization to prepare polymer particles (i.e., a particulate organic material) including the colorant, release agent and other optional additives.

Emulsion Polymerization/Aggregation Methods

A water-soluble initiator and one or more monomers are emulsified in water including a surfactant using a known emulsion polymerization method. An aqueous dispersion in which a colorant, a release agent and optional additives are dispersed in water is added to the emulsion prepared above. Then the particles of the mixture are aggregated, followed by heat treatment to fuse the aggregated particles to form a particulate organic material.

Polymer Suspension Methods

At first, a resin, a prepolymer, a colorant (such as pigments), a release agent, a charge controlling agent and optional additives are dissolved or dispersed in a volatile organic solvent to prepare a toner constituent mixture liquid (i.e., an oil phase liquid). In order to decrease the viscosity of the oil phase liquid, i.e., in order to easily perform emulsification, volatile solvents which can dissolve the resin and prepolymer used are preferably used. The volatile solvents preferably have a boiling point lower than 100° C. so as to be easily removed after the granulating process.

Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The thus prepared oil phase liquid is dispersed in an aqueous medium using the below-mentioned dispersing method.

Suitable aqueous media include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

As the oil phase liquid, an organic solvent including a prepolymer having an active group such as isocyanate groups and other toner constituents such as colorants, release agents and charge controlling agents can also be used. In this case, the prepolymer in the oil phase is reacted with an amine in water, resulting in formation of a particulate organic material.

In order to prepare a stable dispersant in which the oil phase including the prepolymer and other toner constituents in an aqueous medium, it is preferable to mix the oil phase liquid and the aqueous phase while applying a shearing force. The toner constituents such as prepolymers and other constituents can be directly added into an aqueous medium, but it is preferable that the toner constituents are previously dissolved or dispersed in an organic solvent and then the solution or dispersion is mixed with an aqueous medium while applying a shearing force to prepare an emulsion. Further, materials such as colorants, release agents and charge controlling agents can be added to the emulsion or dispersion after the particles are formed. Specifically, colorless particles prepared by the above-mentioned methods can be colored by a known dyeing method.

As the dispersing machine, known mixers and dispersing machines such as low shearing type dispersing machines, high shearing type dispersing machines, friction type dispersing machines, high pressure jet type dispersing machines and ultrasonic dispersing machine can be used. Preferably, homogenizers and high pressure homogenizers, which have a high speed rotor and a stator; and dispersing machines using media such as ball mills, bead mills and sand mills can be used.

In order to prepare a dispersion including particles having an average particle diameter of from 2 to 20 μm, high shearing type dispersing machines such as emulsifiers having a rotating blade are preferably used. Specific examples of the marketed dispersing machines of this type include continuous dispersing machines such as ULTRA-TURRAX® (from IKA Japan). POLYTRON® (from KINEMATICA AG), TK AUTO HOMO MIXER® (from Tokushu Kika Kogyo Co., Ltd.), EBARA MILDER® (from Ebara Corporation), TK PIPELINE HOMO MIXER® (from Tokushu Kika Kogyo Co., Ltd.), TK HOMOMIC LINE MILL® (from Tokushu Kika Kogyo Co., Ltd.), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); and batch type emulsifiers or batch/continuous emulsifiers such as CLEARMIX® (from M Technique) and FILMICS (from Tokushu Kika Kogyo Co., Ltd.).

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 10 to 98° C. The processing temperature is preferably as high as possible because the viscosity of the dispersion decreases and thereby the dispersing operation can be easily performed.

In the dispersing process, the weight ratio of the organic material composition liquid including a prepolymer and other toner constituents to the aqueous medium in which the particulate organic material composition is to be dispersed is generally from 100/50 to 100/2000, and preferably from 100/100 to 100/1000. When the amount of the aqueous medium is too small, the particulate organic material tends not to be well dispersed, and thereby a toner having a desired particle diameter cannot be prepared. In contrast, to use a large amount of aqueous medium is not economical.

The aqueous medium can include not only a surfactant but also a solid particulate dispersant serving as an emulsification stabilizer.

Further, it is possible to stably disperse toner constituents in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmdnoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When the dispersing operation is performed while using a dispersant, it is possible not to remove the dispersant from the resultant particulate organic material. However, it is preferable to remove the dispersant remaining on the surface of the resultant particulate organic material after the elongation and/or crosslinking reaction of the prepolymer.

The elongation time and/or crosslinking time of the particles are determined depending on the reactivity of the isocyanate of the prepolymer (A) used with the amine used. However, the elongation time and/or crosslinking time are typically from 10 minutes to 40 hours, and preferably from 2 to 20 hours. The reaction temperature is typically from 0 to 150° C. and preferably from 40° C. to 98° C. In addition, known catalysts such as dibutyl tin laurate and dioctyl tin laurate can be added, if desired, when the reaction is performed.

In order to remove an organic solvent from the thus prepared emulsion, a method in which the emulsion is gradually heated to perfectly evaporate the organic solvent in the drops of the oil phase can be used. Alternatively, a method in which the emulsion is sprayed in a dry environment to dry the organic solvent in the drops of the oil phase and water in the dispersion, resulting in formation of toner particles, can be used. Specific examples of the dry environment include gases of air, nitrogen, carbon dioxide, combustion gas, etc., which are preferably heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared particulate organic material is surface-treated by the above-mentioned method to prepare the functional particulate organic material (toner) of the present invention.

The thus prepared toner particles are then mixed with one or more other particulate materials such as release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Surface Treatment of Particulate Organic Material

One or more surface treatments other than the surface treatment mentioned above can be performed on the thus prepared particulate organic material to impart, for example, charging ability to the organic material (toner). These surface treatments are preferably performed in a liquid after the surfactant used is removed from the particulate organic material.

Specifically, at first the surfactant present in the aqueous phase is removed, for example, by a solid-liquid separation method such as filtering and centrifugal separation. The resultant cake or slurry is dispersed in an aqueous medium (hereinafter referred to as a re-dispersion process). Then an aqueous solution of a second surfactant having a polarity opposite to that of the first surfactant used for dispersing is dropped thereto while agitating. The use amount of the second surfactant is preferably from 0.01 to 1% by weight based on the total weight of the solid (organic material).

In addition, it is possible to add a particulate charge controlling agent in the slurry prepared in the re-dispersion process to adjust the charging properties of the particulate organic material. Such a particulate charge controlling agent is preferably dispersed previously in an aqueous medium using the first surfactant and/or the second surfactant. Since the dispersion includes the first surfactant and second surfactant having a polarity opposite to that of the first surfactant, the charges are neutralized, and thereby the charge controlling agent in the dispersion fixedly deposits on the surface of the particulate organic material.

When the particulate organic material is a toner, the charge controlling agent preferably has an average particle diameter of from 0.01 to 1 μm in the dispersion. The content of the charge controlling agent is preferably 0.01 to 5% by weight based on the toner weight of the particulate organic material.

In addition, a particulate resin can be added to the dispersion in the re-dispersion process to improve the charge properties of the particulate organic material dispersed in the dispersion. The particulate resin is preferably a resin made by an emulsion polymerization method.

Similarly to the charge controlling agent mentioned above, the particulate resin is also deposited fixedly on the surface of the particulate organic material due to neutralizing in charges caused by mixing of the first and second surfactants. The content of the particulate resin is preferably from 0.01 to 5% by weight based on the total weight of the particulate organic material.

The charge controlling agent and/or the particulate resin thus deposited on the surface of the particulate organic material are fixed thereon by heating the dispersion. Thus, the charge controlling agent and/or the particulate resin can be prevented from releasing from the surface of the particulate organic material. In this regard, the heating is preferably performed at a temperature not lower than the glass transition temperature of the particulate resin.

Charge Controlling Agent

Any known charge controlling agents can be used for the particulate organic material (toner) of the present invention to control the charge properties of the toner. Specific examples of the charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts),. alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

Particulate Resin for Charge Controlling

Particulate resins can be used for the toner of the present invention to control the charge properties of the toner.

Suitable particulate resins include resin particles prepared by a polymerization method such as soap-free emulsion polymerization methods, suspension polymerization methods, dispersion polymerization methods.

Specific examples of the suitable particulate resins include copolymers of styrene and a monomer having a carboxyl group such as methacrylic acid, copolymers of styrene and fluorine-containing methacrylic acid or fluorine-containing acrylic acid, which are prepared by a polymerization method such as emulsion polymerization methods and dispersion polymerization methods; polymers prepared by a polycondensation method and thermosetting resins, such as silicones, benzoguanamine resins and nylon resins; etc.

Surfactant

As mentioned above, surfactants are used for preparing the particulate organic material of the present invention.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di) octylaminoethyle) glycin, and N-alkyl-N,N-dimethylammonium betaine.

The added amount of the surfactant in the aqueous phase is from 0.1 to 10% by weight based on the total weight of the aqueous phase.

By using a fluorine-containing surfactant as the second surfactant, good charging properties and good charge rising property can be imparted to the resultant particulate organic material.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6—C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16) ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACEO F-110, F-120, F-113, F-191, F-812 and F-833 which are manufactured by Dainippon Ink and Chemicals, Inc.; ECTOPO EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl (C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In particular, when fluorine-containing quaternary ammonium salts having the below-mentioned formula (4) are used, the resultant toner has good charge stability even when environmental conditions are changed.

(4)
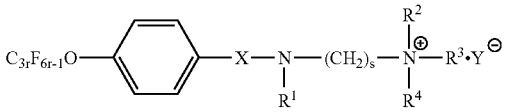
wherein X represents —$SO_2$, or —CO—; Y represents I or Br; $R^1$, $R^2$, $R^3$ and $R^4$ independently represent a hydrogen atom, an alkyl group having 1 to 10 carbon atoms or an aryl group; and each of r and s is an integer of from 1 to 20.
Specific examples of the compounds having formula (4) include the following compounds 1) to 54).
1)
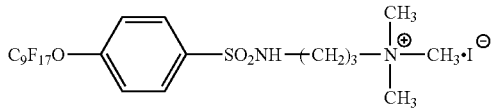
2)
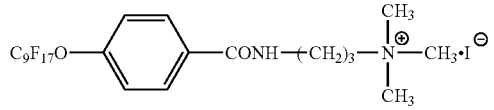
3)
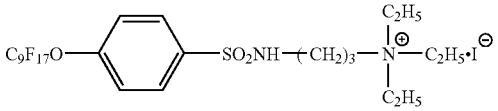
4)
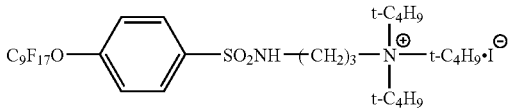
5)
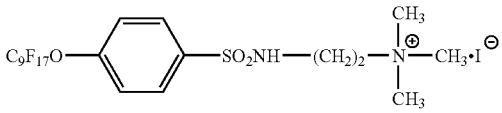
6)
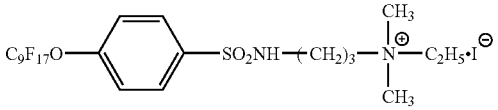
7)
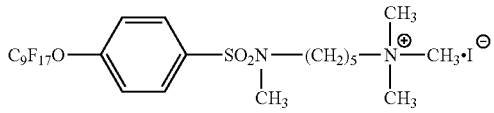
8)
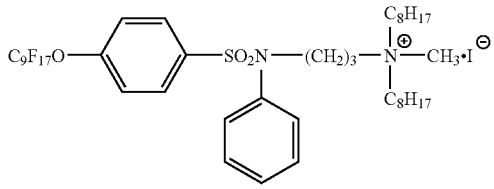
9)
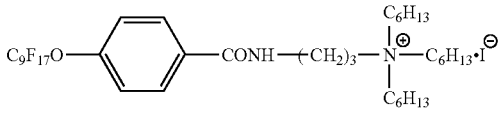
-continued
10)
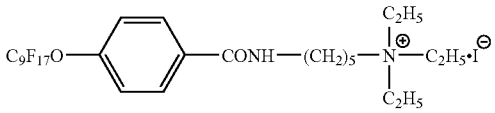
11)
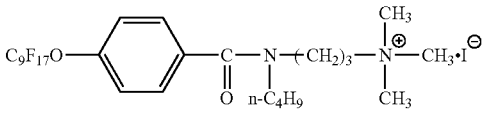
12)
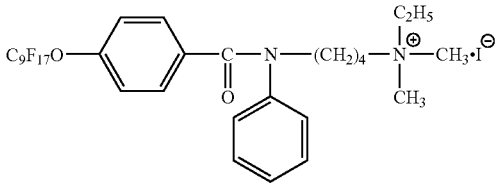
13)
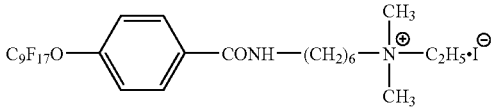
14)
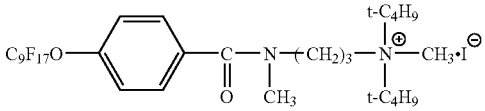
15)
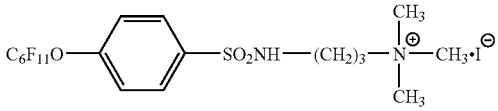
16)
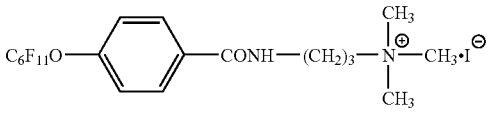
17)
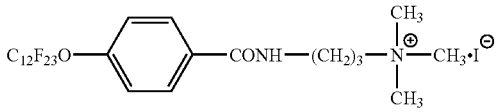
18)
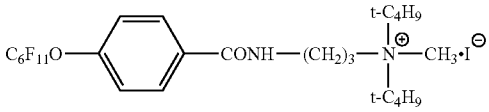
19)
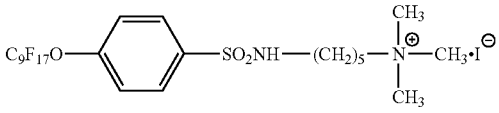
20)
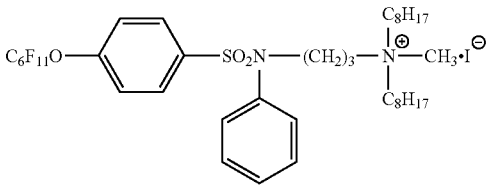

-continued
21)
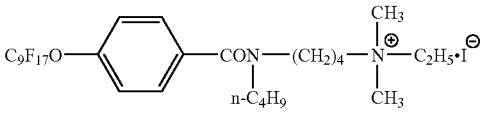
22)
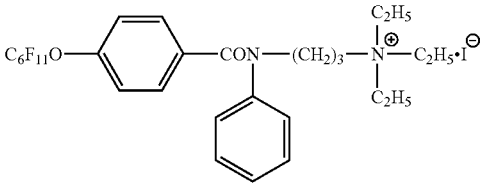
23)
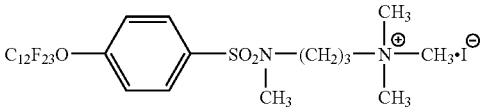
24)
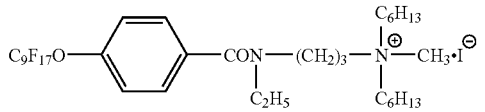
25)
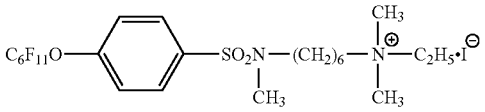
26)
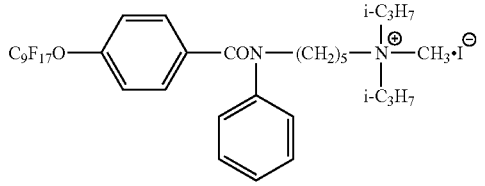
27)
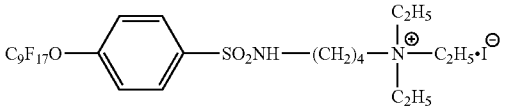
28)
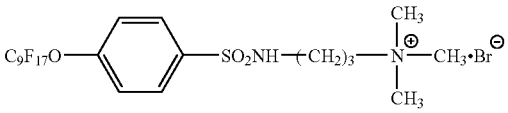
29)
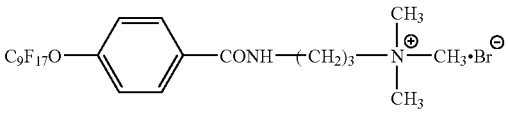
30)
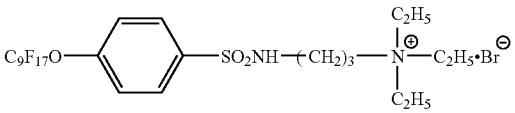
31)
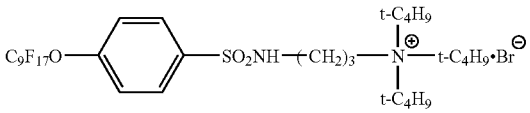
-continued
32)
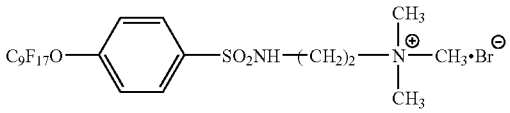
33)
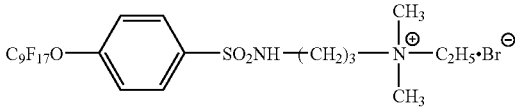
34)
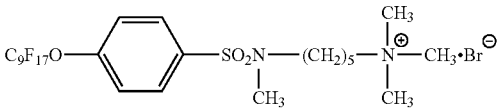
35)
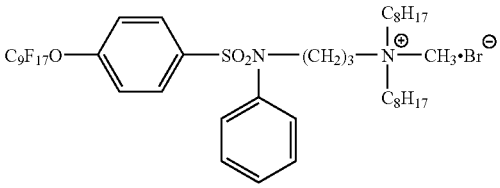
36)
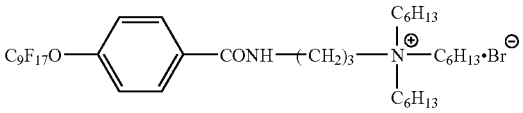
37)
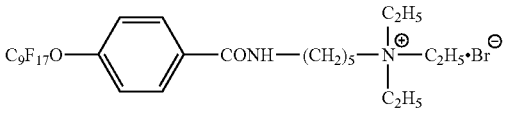
38)
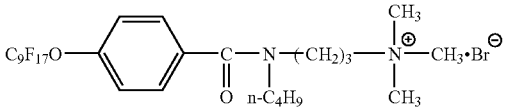
39)
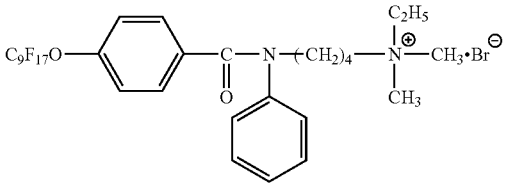
40)
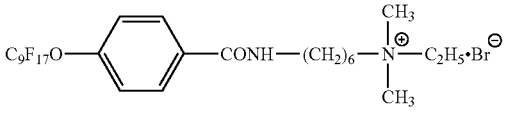
41)
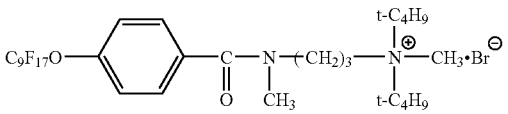

-continued

42)

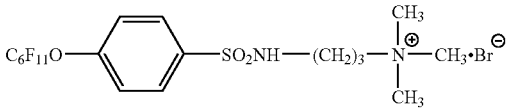

43)

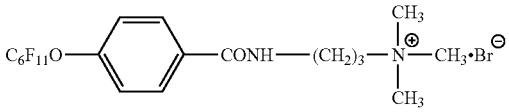

44)

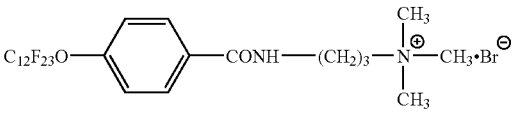

45)

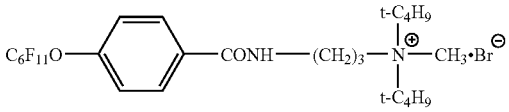

46)

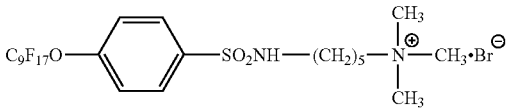

47)

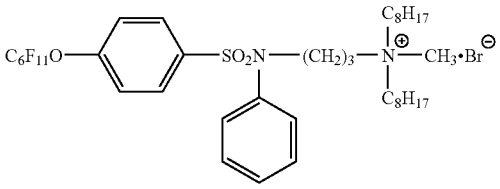

48)

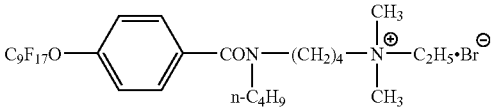

49)

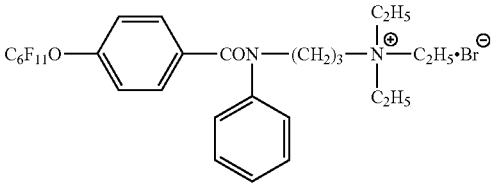

50)

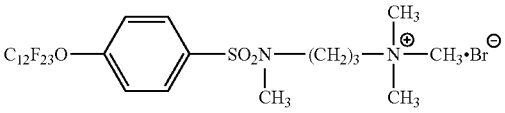

51)

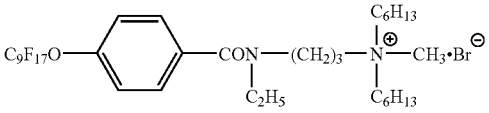

-continued

52)

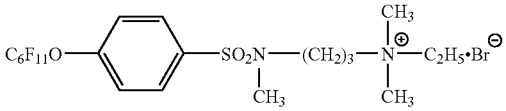

53)

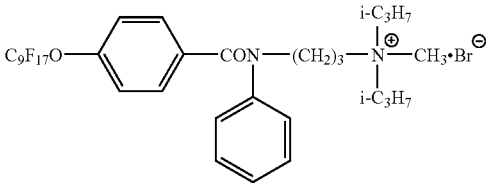

54)

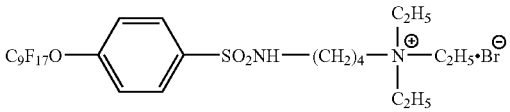

Particulate Solid Dispersant

Suitable particulate solid dispersants for use in the method for preparing the toner of the present invention include particulate materials which hardly soluble in water and which have an average particle diameter of from 0.01 to 1 μm.

Specific examples of such materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, tricalcium phosphate, calcium carbonate, colloidal titanium oxide, colloidal silica, and hydroxyapatite etc.

Among the materials, tricalcium phosphate, calcium carbonate, colloidal titanium oxide, colloidal silica, and hydroxyapatite can be preferably used. Particularly, hydroxyapatite which is synthesized by reacting sodium phosphate with calcium chloride under alkaline conditions is more preferable.

In addition, particles of low molecular weight organic compounds; and polymers such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the solid dispersant for use in the toner of the present invention.

Prepolymer (A) having an Isocyanate Group at its End Portion

As the polyester prepolymer (A), for example, compounds prepared by reacting a polycondensation product of a polyol (1) and a polycarboxylic acid (2) including a group having an active hydrogen with a polyisocyanate (3) are used. Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferable.

Suitable polyols (1) include diols (1-1) and polyols (1-2) having three or more hydroxyl groups. Preferably, diols (1-1) or mixtures in which a small amount of a polyol (1-2) is added to a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include dicarboxylic acids (2-1) and polycarboxylic acids (2-2) having three or more carboxyl groups. Preferably, dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of (the [OH] of) a polyol (1) to (the [COOH] of) a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of (the [NCO] of) a polyisocyanate (3) to (the [OH] of) a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance deteriorate.

Specific examples of the amines (B) include diamines (Bl), polyamines (B2) having three or more amino groups, amino alcohols (B3), amino mercaptans (B4), amino acids (B5) and blocked amines (B6) in which the amines (B1-B5) mentioned above are blocked.

Specific examples of the amines (1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (Bi) and mixtures in which a diamine is mixed with a small amount of a polyamine (B2) are preferably used.

The molecular weight of the urea-modified polyesters can be controlled using an elongation inhibitor, if desired. Specific examples of the elongation inhibitor include monoamines (e.g., diethyl amine, dibutyl amine, butyl amine and lauryl amine), and blocked amines (i.e., ketimine compounds) prepared by blocking the monoamines mentioned above.

Themixingratio (i.e., a ratio [NCO]/[NHx]) of (the [NCO] of) the prepolymer (A) having an isocyanate group to (the [NHx] of) the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

Unmodified Polyester Resin (UMPE)

It is preferable to use a combination of a urea-modified polyester resin with an unmodified polyester resin (UMPE) as the binder resin of the toner of the present invention. By using such a combination, the low temperature fixability of the toner can be improved and in addition the toner can produce color images having a high glossiness.

Suitable materials for use as the unmodified polyester resins (UMPE) include polycondensation products of a polyol (1) with apolycarboxylic acid (2). Specific examples of the polyol (1) and polycarboxylic acid (2) are mentioned above for use in the modified polyester resins. In addition, specific examples of the suitable polyol and polycarboxylic acid are also mentioned above.

In addition, polyester resins modified by a bonding (such as urethane bonding) other than a urea bonding are considered as the unmodified polyester resin in the present application.

When a combination of a modified polyester resin with an unmodified polyester resin is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (MPE/UMPE) of a modified polyester resin (MPE) to an unmodified polyester resin (UMPE) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to achieve a good combination of high-temperature preservability and low temperature fixability.

The peak molecular weight of the unmodified polyester resins (UMPE) is from 1,000 to 30,000, preferably from 1,500 to 10,000 and more preferably from 2,000 to 8,000. When the peak molecular weight is too low, the high-temperature preservability-of the toner deteriorates. In contrast, when the peak molecular weight is too high, the low temperature fixability of the toner deteriorates.

The unmodified polyester resin (UMPE) preferably has a hydroxyl value not less than 5 mgKOH/g, and more preferably from 10 to 120 mgKOH/g, and even more preferably from 20 to 80 mgKOH/g. When the hydroxyl value is too small, the resultant toner has poor preservability and poor low temperature fixability.

The unmodified polyester resin (UMPE) preferably has an acid value of from 1 to 30 mgKOH/g, and more preferably from 5 to 20 mgKOH/g. When a wax having a high acid value is used as a release agent, good negative charge property can be imparted to the toner.

Method for Manufacturing Dry Toner

The particulate organic material of the present invention can be used for a dry toner. The manufacturing method is mentioned below.

The binder resin in the toner of the present invention preferably has a glass transition temperature (Tg) of from 50 to 70° C. and more preferably from 55 to 65° C. When the glass transition temperature is too low, the preservability of the toner deteriorates. In contrast, when the glass transition temperature is too high, the low temperature fixability deteriorates. When the toner of the present invention includes a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners.

With respect to the storage modulus of the toner binder for use in the toner of the present invention, the temperature (TG') at which the storage modulus is 10,000 dyne/cm$^2$ when measured at a frequency of 20 Hz is not lower than 100° C., and preferably from 110 to 200° C.

With respect to the viscosity of the binder resin, the temperature (Tη) at which the viscosity is 1,000 poise when measured at a frequency of 20 Hz is not higher than 180° C., and preferably from 90 to 160° C. When the temperature (Tη) is too high, the low temperature fixability of the toner deteriorates. In order to achieve a good combination of low temperature fixability and hot offset resistance, it is preferable that the TG' is higher than the Tη. Specifically, the difference (TG'-Tη) is preferably not less than 0° C., preferably not less than 10° C. and more preferably not less than 20° C. The difference particularly has an upper limit. In order to achieve a good combination of high temperature preservability and low temperature fixability, the difference (TG'-Tη) is preferably from 0 to 100° C., more preferably from 10 to 90° C. and even more preferably from 20 to 80° C.

Colorant

When the functional particulate organic material of the present invention is used as an electrophotographic toner, the toner includes a colorant. Suitable materials for use as the colorant include known dyes and pigments.

Specific examples of the dyes and pigments include carbon black, Nigrosinedyes, blackironoxide, NaphtholYellowS (C.I. 10316), Hansa Yellow 10G (C.I. 11710), Hansa Yellow 5G (C.I. 11660), HansaYellowG (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), PermanentRedFRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussianblue, AnthraquinoneBlue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Release Agent

The toner of the present invention can include a wax as a release agent in combination with a binder resin and a colorant.

Known waxes can be used for the toner of the present invention. Specific examples of the waxes include polyolefin waxes such as polyethylene waxes and polypropylene waxes; hydrocarbons having a long chain such as paraffin waxes and SASOL waxes; and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone) Among these waxes having a carbonyl group, polyalkananoic acid esters are preferably used.

The melting point of the waxes for use in the toner of the present invention is from 40 to 160° C., preferably from 50 to 120° C., more preferably from 60 to 90° C. When the melting point of the wax used is too low, the preservability of the resultant toner deteriorates. In contrast, when the melting point is too high, the resultant toner tends to cause a cold offset problem in that a toner image adheres to a fixing roller when the toner image is fixed at a relatively low fixing temperature.

The waxes preferably have a melt viscosity of from 5 to 1000 cps (i.e., 5 to 1000 mPa.s), and more preferably from 10 to 100 cps, at a temperature 20° C. higher than the melting point thereof. Waxes having too high a melt viscosity hardly produce offset resistance improving effect and low temperature fixability improving effect.

The content of a wax in the toner of the present invention is generally from 0 to 40% by weight, and preferably from 3 to 30% by weight.

Dry Toner Manufacturing Method

When it is desired to control the shape of mother toner particles, the following methods can be used:

(1) toner particles prepared by kneading toner constituents and then pulverizing the kneaded mixture are subjected to a mechanical shape adjusting treatment using HYBRIDIZER or MECHANO FUSION SYSTEM (manufactured by Hosokawa Micron Corp.);

(2) a toner constituent mixture dissolved in a solvent which can dissolve the binder resin in the toner constituents is sprayed using a spray drying device to form a spherical toner; and (3) toner particles are heated in an aqueous medium to form spherical toner particles.

However, the shape adjusting method is not limited thereto. These shape controlling operations are performed before the surface treatment mentioned above.

When the thus prepared functional particulate organic material is used as the toner of the present invention, the toner is typically prepared by the method mentioned below. However, the manufacturing method is not limited thereto.

The functional particulate organic material (hereinafter referred to as mother toner particles) prepared above is mixed with an external additive (e.g., hydrophobized silica and titanium oxide) using a mixer to improve fluidity, developing properties and transferring properties.

Suitable mixers for use in mixing the mother toner particles and an external additive include known mixers for mixing powders, which preferably have a jacket to control the inside temperature thereof.

By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed.

In addition, a mixing method in which at first a relatively high stress is applied and then a relatively low stress is applied to the external additive, or vice versa, can also be used.

Specific examples of the mixers include V-form mixers, locking mixers, Loedge Mixers, Nauter Mixers, Henschel Mixers and the like mixers.

External Additive

Inorganic fine particles are typically used as the external additive (i.e., fluidity improving agent). Inorganic particulate materials having a primary particle diameter of from 5 nm to 2 μm, and preferably from 5 nm to 500 nm, are preferably used. The surface area of the inorganic particulate materials is preferably from 20 to 500 $m^2/g$ when measured by a BET method.

The content of the inorganic particulate material is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, ceriumoxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, silylation agents, silane coupling agents having a fluorinated alkyl group, organic titanate coupling agents, aluminum coupling agents, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

Carrier for Use in Two Component Developer

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

Then the image forming method and apparatus of the present invention, which produce images using the toner of the present invention, will be explained referring to drawings.

FIG. 1 is a schematic view illustrating an electrophotographic image forming apparatus for use in the image forming method of the present invention. The below-mentioned modified versions can also be included in the scope of the present invention.

In FIG. 1, numeral 1 denotes a photoreceptor serving as an image bearing member.

The photoreceptor 1 has a drum form, but photoreceptors having a form such as sheet-form and endless belt-form can also be used.

Around the photoreceptor 1, a quenching lamp 10 configured to decrease charges remaining on the photoreceptor 1, a charger 2 configured to charge the photoreceptor 1, an imagewise light irradiator 3 configured to irradiate the photoreceptor 1 with imagewise light to form an electrostatic latent image on the photoreceptor 1, an image developer 4 configured to develop the latent image with a developer 5 including the toner of the present invention to form a toner image on the photoreceptor 1, and a cleaning unit 7 including a cleaning blade configured to clean the surface of the photoreceptor 1 are arranged while contacting or being set closely to the photoreceptor 1. The toner image formed on the photoreceptor 1 is transferred on a receiving paper 8 by a transfer device 6. The toner image on the receiving paper 8 is fixed thereon by a fixer 9.

The image developer 4 includes a developing roller 41 serving as a developer bearing member and a developing blade 100 configured to form a uniform thin developer layer on the surface of the developing roller 41. The electrostatic latent image formed on the photoreceptor 1 is developed with the toner in the developer layer formed on the surface of the developing roller 41.

As the charger 2, any known chargers such as corotrons, scorotrons, solid state chargers, and roller chargers can be used. Among the chargers, contact chargers and short-range chargers are preferably used because of consuming low power. In particularly, short-range chargers which charge a photoreceptor while a proper gap is formed between the chargers and the surface of the photoreceptor are more preferably used.

As the transfer device 6, the above-mentioned known chargers can be used. Among the chargers, a combination of a transfer charger and a separating charger is preferably used.

Suitable light sources for use in the imagewise light irradiator 3 and the quenching lamp 10 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

When the toner image formed on the photoreceptor 1 by the image developer 4 is transferred onto the receiving paper 8, all of the toner image are not transferred on the receiving paper 8, and toner particles remain on the surface of the photoreceptor 1. The residual toner is removed from the photoreceptor 1 by the cleaner 7. Suitable cleaners for use as the cleaner 7 include cleaning blades made of a rubber, fur blushes and mag-fur blushes.

When the photoreceptor 1 which is previously charged positively (or negatively) is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

Figure 2:
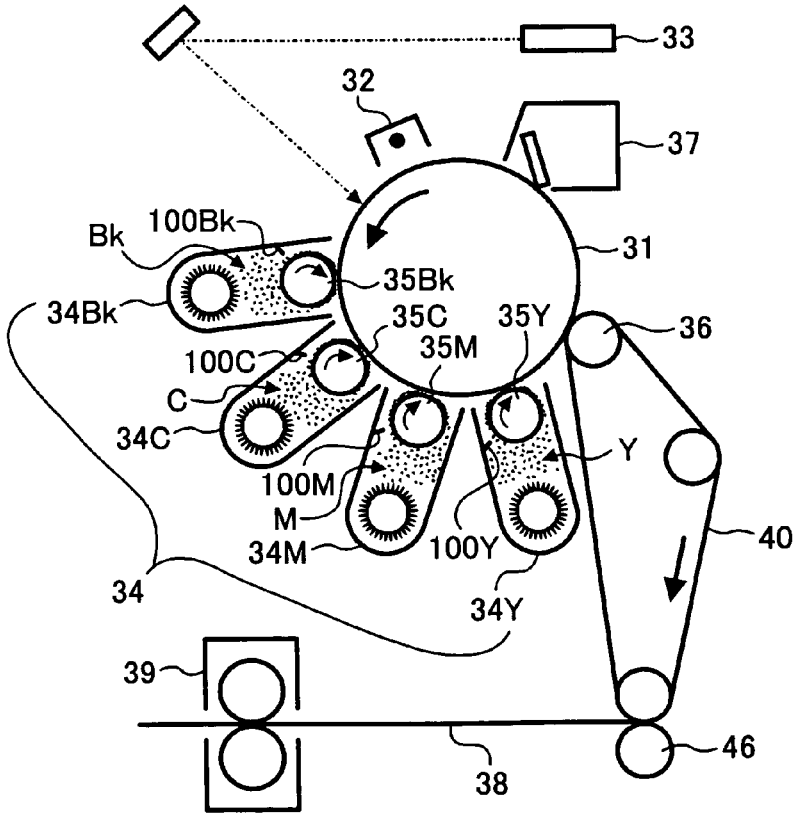
FIG. 2 is a schematic view illustrating another image forming apparatus for use in the image forming method of the present invention, which includes plural developing devices.

FIG. 2 illustrates another image forming apparatus for use in the image forming method of the present invention, which can produce full color images. Referring to FIG. 2, the image forming apparatus has a photoreceptor 31. Around the photoreceptor 31, a charger 32, an imagewise light irradiator 33, an image developing unit 34 having a black image developer 34Bk, a cyan image developer 34C, a magenta image developer 34M and a yellow image developer 34Y, an intermediate transfer belt 40 serving as an intermediate transfer medium, and a cleaner 37 are arranged.

The image developers 34Bk, 34C, 34M and 34Y can be independently controlled, and each of the image developers is independently driven when desired. In each of the image developers, an electrostatic latent image formed on the photoreceptor 31 is developed with a toner layer formed on a developing roller 35Bk, 35C, 35M or 35Y by a developing blade 100Bk, 100C, 100*m* or 100Y, respectively. Characters Bk, C, M and Y denote black, cyan, magenta and yellow color toners of the present invention, respectively. The color toner images thus formed on the photoreceptor 31 are transferred onto the intermediate transfer belt 40 by a first transfer device 36. In this case, it is preferable to apply a voltage to the first transfer device 36 to place the toner image in an electric field. The intermediate transfer belt 40 is brought into contact with the photoreceptor 31 by the first transfer device 36 only when a toner image on the photoreceptor 31 is transferred thereto. The toner images overlaid on the intermediate transfer belt 40 are transferred onto a receiving material 38 by a second transfer device 46, and the full color toner images are fixed on the receiving material 38 by a fixer 39. The second transfer device 46 is brought into contact with the intermediate transfer belt 40 only when the transfer operation is performed.

In an image forming apparatus having a drum-form transfer device, color toner images are transferred onto a receiving material electrostatically attached to the transfer drum. Therefore, an image cannot be formed on a thick paper. However, in the image forming apparatus as illustrated in FIG. 2, each toner image is formed on the intermediate transfer belt and the overlaid toner images are transferred onto a receiving material while applying a pressure thereto. Therefore, an image can be formed on any kinds of receiving materials. The image forming method using an intermediate transfer medium can also be applied to the image forming apparatus as illustrated in FIG. 1.

Figure 3:
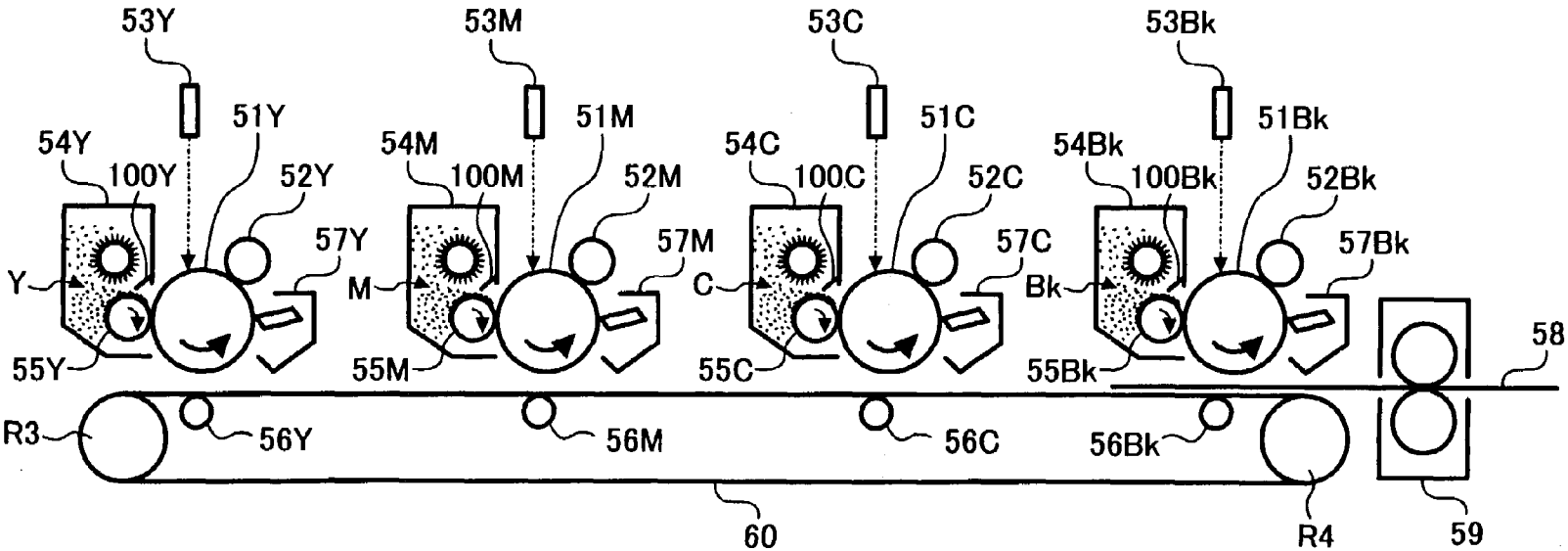
FIG. 3 is a schematic view illustrating another image forming apparatus for use in the image forming method of the present invention, which includes four image bearing members and respective developing devices.

FIG. 3 illustrates yet another image forming apparatus for use in the image forming method of the present invention.

The image forming apparatus has four color image forming sections, i.e., yellow, magenta, cyan and black image forming sections. The image forming sections include respective photoreceptors 51Y, 51M, 51C and 51Bk.

Around each of the photoreceptors 51Y, 51M, 51C and 51Bk, a charger (52Y, 52M, 52C or 52Bk), an imagewise light irradiator (53Y, 53M, 53C or 53Bk), an image developer (54Y, 54M, 54C or 54Bk), and a cleaner (57Y, 57M, 57C or 57Bk) are arranged. Each image developer (54Y, 54M, 54C or 54Bk) includes a developing roller (55Y, 55M, 55C or 55Bk) and a developing blade (10Y, 100M, 100C or 100Bk). In addition, a feed/transfer belt 60, which is arranged below the image forming sections, is tightly stretched by rollers R3 and R4. The feed/transfer belt 60 is attached to or detached from the photoreceptors by transfer devices 56Y, 56M, 56C and 56Bk to transfer toner images from the photoreceptors to a receiving material 58. The resultant color toner image is fixed by a fixer 59.

The tandem-type image forming apparatus illustrated in FIG. 3 has four photoreceptors for forming four color images, and color toner images which can be formed in parallel can be transferred onto the receiving material 58. Therefore, the image forming apparatus can form full color images at a high speed.

Each of the image developer (54Y, 54M, 54C or 54Bk) also includes a blade (100Y, 100M, 100C or 100Bk) and a toner (Y, M, C or Bk).

The above-mentioned image forming unit may be fixedly set in a copier, a facsimile or a printer. However, the image forming unit may be set therein as a process cartridge. The process cartridge means an image forming unit which includes at least a container containing the toner of the present invention or a developer including the toner of the present invention and optionally includes one or more devices selected from the group consisting of an image bearing member (such as photoreceptors), a charger, an image developer and a cleaner.

Figure 4:
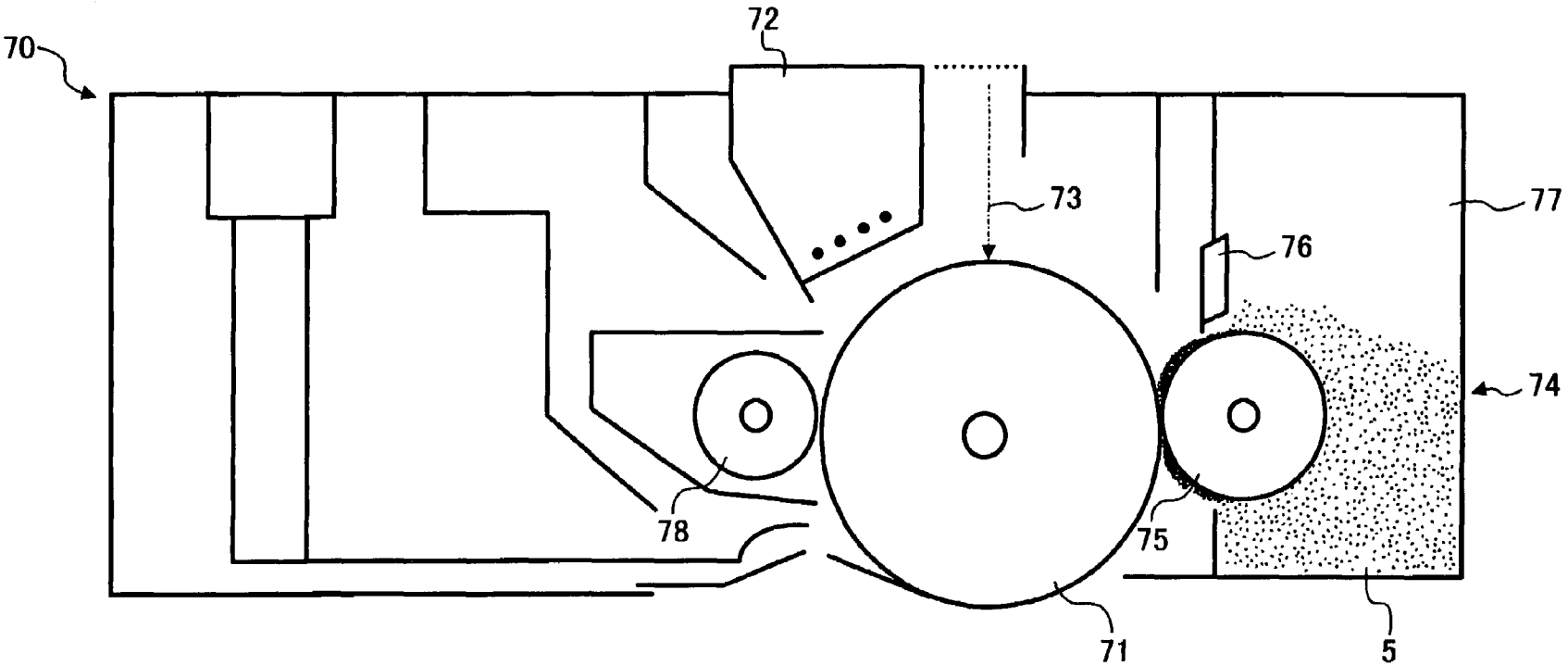
FIG. 4 is a schematic view illustrating an embodiment of the process cartridge of the present invention.

FIG. 4 is a schematic view illustrating an embodiment of the process cartridge of the present invention. In FIG. 4, a process cartridge 70 includes a photoreceptor 71 serving as an electrostatic latent image bearing member, a charger 72 configured to charge the photoreceptor 71, an image developer (a developing roller) 74 configured to develop the latent image with the developer 5 including the toner of the present invention, and a cleaning brush 78 configured to clean the surface of the photoreceptor 71. Numeral 73 denotes an imagewise light beam configured to irradiate the photoreceptor 71 to form an electrostatic latent image on the photoreceptor 71.

The image developer 74 includes a developer container 77 configured to contain the developer 5 including the toner of the present invention, a developing roller 75 configured to develop the latent image on the surface of the photoreceptor 71 and a developer blade 76 configured to form a uniform thin layer of the developer 5 on the developing roller 75.

The structure of the process cartridge of the present invention is not limited to that illustrated in FIG. 4.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Unmodified Polyester

The following components were contained in a reaction container having a condenser, a stirrer and a nitrogen introducing tube to perform a polycondensation reaction for 8 hours at 230° C. under normal pressure.

| | |
|---|---|
| Adduct of bisphenol A with 2 mole of ethylene oxide | 724 parts |
| Terephthalic acid | 276 parts |
| Dibutyl tin oxide | 2 parts |

Then the reaction was further continued for 5 hours under a reduced pressure of from 10 to 15 mmHg. Thus, an unmodified polyester resin having a peak molecular weight of 4800 was prepared.

One hundred (100) parts of the polyester resin were dissolved in 100 parts of ethyl acetate to prepare an ethyl acetate solution of the binder resin.

A part of the resin solution was dried to solidify the polyester resin. The polyester resin had a glass transition temperature of 58° C., and an acid value of 8 mgKOH/g.

Example 1

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Thus, an organic material composition liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then the organic material composition liquid prepared above was added thereto, and the mixture was agitated for 3 minutes to prepare an emulsion.

Then the emulsion was transferred to a flask with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate is not higher than 100 ppm in the dispersion.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight. Then, a 1% by weight aqueous solution of sodium hydroxide was added to the dispersion and the mixture was agitated for 15 minutes while the temperature thereof was maintained at 20° C. In this case, the added amount of the aqueous solution of sodium hydroxide is such that the weight of sodium in the solution is 0.013% by weight based on the weight of the solid of the organic material dispersed therein. In addition, a 1% by weight aqueous solution of aluminum chloride was added thereto and the mixture was agitated for 15 minutes while the temperature of the mixture was maintained at 20° C. In this case, the added amount of the aqueous solution of aluminum chloride is such that the weight of aluminum in the solution is 0.015% by weight based on the weight of the solid of the organic material dispersed therein, wherein the molar ratio of sodium to aluminum is 1/1.

Finally, a 1% by weight aqueous solution of sodium 3,5-di-tert-butylsalicylate was dropped into the mixture and the mixture was agitated for 1 hour while the temperature of the mixture was maintained at 20° C. In this case, the added amount of the aqueous solution of sodium 3,5-di-tert-butylsalicylate is such that the weight of 3,5-di-tert-butylsalicylic acid in the solution is 0.285% by weight based on the weight of the solid of the organic material dispersed therein.

Then the dispersion was filtered and the resultant cake was dried for 24 hours at 40° C. under a reduced pressure. Thus, a particulate organic material having an average particle diameter of 5.0±0.5 μm was prepared.

Preparation of Polyester having Isocyanate Group at its End Portion

The following components were contained in a reaction container equipped with a condenser, a stirrer and a nitrogen introducing tube and reacted for 8 hours at 230° C. under normal pressure.

| | |
|---|---|
| Adduct of bisphenol A with 2 mole of ethylene oxide | 724 parts |
| Isophthalic acid | 276 parts |
| Dibutyl tin oxide | 2 parts |

Then the reaction was further continued for 5 hours under a reduced pressure of from 10 to 15 mmHg, followed by cooling to 160° C. Further, 32 parts of phthalic anhydride were added thereto to perform a reaction for 2 hours at 160° C.

After being cooled to 80° C., the reaction product was reacted with 188 parts of isophorone diisocyanate in ethyl acetate for 2 hours. Thus, a prepolymer having an isocyanate group was prepared.

Preparation of Ketimine Compound

In a reaction container equipped with a stirrer and a thermometer, 170 parts of isophorone diamine and 75 parts of methyl ethyl ketone were contained and reacted for 5 hours at 50° C. to prepare a ketimine compound. The ketimine compound has an amine value of 418 mgKOH/g.

Example 2

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the prepolymer prepared above was added thereto in such an amount that the solid of the prepolymer is 20 parts and the mixture was agitated. Thus, an organic material composition liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then a mixture (i.e., an oil phase liquid) of the organic material composition liquid prepared above and 1 part of the above-prepared ketimine compound which had been added to the organic material composition liquid just before was added thereto, and the mixture was agitated for 3 minutes to prepare an emulsion.

Then the emulsion was transferred to a flask with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation wasperformedthree times. The thuspreparedcakewas dispersed again in distilled water so that the solid content is 10% by weight.

Then, a 1% by weight aqueous solution of sodium hydroxide was added to the dispersion and the mixture was agitated for 15 minutes while the temperature thereof was maintained at 20° C. In this case, the added amount of the aqueous solution of sodium hydroxide is such that the weight of sodium in the solution is 0.012% by weight based on the weight of the solid of the organic material dispersed therein. In addition, a 1% by weight aqueous solution of ferric chloride was added thereto and the mixture was agitated for 15 minutes while the temperature of the mixture was maintained at 20° C. In this case, the added amount of the aqueous solution of ferric chloride is such that the weight of iron included in the solution is 0.030% by weight based on the weight of the solid of the organic material dispersed therein, wherein the molar ratio of sodium to iron is 1/1.

Finally, a 1% by weight aqueous solution of sodium 3,5-di-tert-butylsalicylate was dropped into the mixture and the mixture was agitated for 1 hour while the temperature of the mixture was maintained at 20° C. In this case, the added amount of the aqueous solution of sodium 3,5-di-tert-butylsalicylate is such that the weight of 3,5-di-tert-butylsalicylic acid in the solution is 0.270% by weight based on the weight of the solid of the organic material dispersed therein.

Then the mixture was filtered and the resultant cake was dried for 24 hours at 40° C. under a reduced pressure. Thus, a particulate organic material having an average particle diameter of 5.0±0.5 μm was prepared.

Example 3

The procedure for preparation of the functional particulate organic material of Example 1 was repeated except that the amount of sodium in sodium hydroxide used for the surface treatment was changed from 0.013 to 0.012% by weight; the 1% by weight aqueous solution of ferric chloride was replaced with 1% by weight aqueous solution of chromium sulfate which was added in such an amount that the chromium content is 0.028% by weight based on the total weight of the organic material; and the added amount of sodium 3,5-di-tert-butylsalicylate was changed from 0.285% by weight to 0.272% by weight. Then the dispersion was filtered, and the resultant cake was dried for 24 hours at 40° C. under a reduced pressure. Thus a functional particulate organic material with an average particle diameter of 5.0±0.5 μm was prepared.

Example 4

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Thus, an organic material composition liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then the organic material composition liquid prepared above was added thereto, and the mixture was agitated for 3 minutes to prepare an emulsion.

Then the emulsion was transferred to a flask equipped with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation wasperformedthree times. The thuspreparedcakewas dispersed again in distilled water so that the solid content is 10% by weight.

Then, a 1% by weight aqueous solution of sodium hydroxide was added to the dispersion and the mixture was agitated for 15 minutes while the temperature thereof was maintained at 20° C. In this case, the added amount of the aqueous solution of sodium hydroxide is such that the weight of sodium included in the solution is 0.034% by weight based on the weight of the solid of the organic material dispersed therein. In addition, a 1% by weight aqueous solution of aluminum chloride was added thereto and the mixture was agitated for 15 minutes while the temperature of the mixture was maintained at 20° C. In this case, the added amount of the aqueous solution of aluminum chloride is such that the weight of aluminum in the solution is 0.029% by weight based on the weight of the solid of the organic material dispersed therein, wherein the molar ratio of sodium to aluminum is 1/1.

Finally, a 1% by weight aqueous solution of sodium 3,5-di-tert-butylsalicylate was dropped into the mixture and the mixture was agitated for 1 hour while the temperature of the mixture was maintained at 20° C. In this case, the added amount of the aqueous solution of sodium 3,5-di-tert-butylsalicylate is such that the weight of 3,5-di-tert-butylsalicylic acid in the solution is 0.029% by weight based on the weight of the solid of the organic material dispersed therein.

Further, the mixture was heated to 40° C. and agitated for 1 hour. Thus, a particulate organic material having an average particle diameter of 5.0±0.5 μm was prepared.

Analysis of Particulate Organic Material

When the amounts of each of the metals present on the surface of the functional particulate organic material were determined by ESCA (X-ray photoelectron spectroscopy), it was confirmed that the predetermined amounts of metals are bonded to the organic material (i.e., the metals are quantitatively bonded to the organic material).

In addition, an alkali was added to the slurry of the particulate organic material so that the slurry has a pH greater than 7. Then the slurry was filtered to separate the particulate organic material (i.e., a toner) from the filtrate. The filtrate was neutralized using hydrochloric acid, and chloroform having the same weight as that of the filtrate was added thereto. The mixture was agitated and then allowed to settle to separate the oil phase from the aqueous phase. Then the content of 3,5-di-tert-butylsalicylic acid included in the oil phase was determined by a high speed liquid chromatography. As a result thereof, it was confirmed that the predetermined amount of 3,5-di-tert-butylsalicylic acid is bonded to the particulate organic material (i.e., 3,5-di-tert-butylsalicylic acid is quantitatively bonded to the particulate organic material).

The particulate organic material (i.e., toner particles) was dispersed in water, and the mixture was dispersed for 30 minutes using an ultrasonic dispersing machine, followed by centrifugal separation. As a result, the supernatant liquid was perfectly clear, and fine particles of the surface modifying agents were not observed therein. Therefore, it was confirmed that the surface modifying agents are firmly bonded with the surface of the particulate organic material.

Evaluation of Particulate Organic Material

When the resultant particulate organic materials were used as electrophotographic toners, it was confirmed that the toners have good charge properties. When images were produced using the toners, high quality images can be produced. Therefore, it was confirmed that desired functions can be easily imparted to the toner by the surface modifying technique of the present invention at low costs. In addition, it was also confirmed that a variety of surface modifying agents can be firmly fixed on the surface of the particulate organic material without causing problems such as morphologic alteration.

Comparative Example 1

The procedure for preparation of the functional particulate organic material in Example 1 was repeated except that the surface modifying treatment was not performed (i.e., the solutions of addition of sodium hydroxide, aluminum chloride, and sodium of 3,5-di-tert-butylsalicylate were replaced with the same amount of water).

Thus, a comparative toner was prepared.

Comparative Example 2

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Thus, an organic material composition was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then the organic material composition liquid prepared above was added thereto, and the mixture was agitated for 3 minutes to prepare an emulsion.

Then the emulsion was transferred to a flask equipped with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate therein is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. Thethuspreparedcakewas dispersed again in distilled water so that the solid content is 10% by weight.

Then, 1% by weight aqueous solution of zinc sulfate was added to the dispersion and the mixture was agitated for 15 minutes while the temperature thereof was maintained at 50° C. In this case, the added amount of the aqueous solution of sodium hydroxide is such that the weight of zinc included in the solution is 0.21% by weight based on the weight of the solid of the organic material dispersed therein. In addition, a 1% by weight aqueous solution of sodium hydroxide was added thereto so that the mixture has a pH of 10, and the mixture was agitated for 15 minutes while the temperature of the mixture was maintained at 50° C.

Finally, after the temperature was increased to 85° C., a 1% by weight aqueous solution of sodium 3,5-di-tert-butylsalicylate was dropped into the mixture and the mixture was agitated for 1 hour. In this case, the added amount of the aqueous solution of sodium 3,5-di-tert-butylsalicylate is such that the weight of 3,5-di-tert-butylsalicylic acid in the solution is 0.79% by weight based on the weight of the solid of the organic material dispersed therein.

Further, the mixture was filtered and the resultant cake was dried for 24 hours at 40° C. to prepare toner particles. Then 100 parts of the toner particles were mixed with 0.5 parts of a hydrophobic silica and 0.5 parts of a hydrophobic titanium, and the mixture was agitated by a HENSCHEL mixer. Thus, a comparative toner was prepared.

Comparative Example 3

The procedure for preparation of the particulate organic material in Example 1 was repeated except that the 1% by weight aqueous solution of ferric chloride was replaced with 1% by weight aqueous solution of calcium chloride which was added in such an amount that the calcium content is 0.022% by weight based on the total weight of the organic material; and the added amount of sodium 3,5-di-tert-butylsalicylate (i.e., the weight of 3,5-di-tert-butylsalicylate) was changed from 0.285% by weight to 0.278% by weight. Thus a comparative toner was prepared.

Comparative Example 4

The procedure for preparation of the particulate organic material in Example 1 was repeated except that the added amount of sodium hydroxide (i.e., the weight of sodium) was changed from 0.013 to 0.011% by weight; the 1% by weight aqueous solution of ferric chloride was replaced with 1% by weight aqueous solution of zirconium oxychloride which was added in such an amount that the oxyzirconium content is 0.053% by weight based on the total weight of the organic material; and the added amount of sodium 3,5-di-tert-butylsalicylate (i.e., the weight of 3,5-di-tert-butylsalicylate) was changed from 0.285% by weight to 0.247% by weight. Thus a comparative toner was prepared.

Preparation of Charge Controlling Agent Dispersion (1)

Ten (10) parts of zinc di-tert-butylsalicylate and 1 part of sodium dodecylbenzenesulfonate were mixed with 100 parts of distilled water in a ball mill pot containing zirconia balls with a diameter of 5 mm to be subjected to ball milling for 24 hours. Thus, a charge controlling agent dispersion (1) was prepared. The particle diameter of each particle of zinc di-tert-butylsalicylate was not greater than 1 μm.

Example 5

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the prepolymer prepared above was added thereto in such an amount that the solid of the prepolymer is 20 parts, and the mixture was agitated. Thus, a toner composition liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then a mixture (i.e., an oil phase liquid) of the toner composition liquid prepared above and 1 part of the ketimine compound prepared above, which had been added to the organic material dispersion just before, was added thereto, and the mixture was agitated for 3 minutes to prepare an emulsion.

Then the emulsion was transferred to a flask with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate therein is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight.

Then, 1% by weight of an aqueous solution of sodium hydroxide was added to the dispersion and the mixture was agitated for 15 minutes while the temperature thereof was maintained at 20° C. In this case, the added amount of the aqueous solution of sodium hydroxide is such that the weight of sodium in the solution is 0.013% by weight based on the weight of the solid of the particles dispersed therein. In addition, a 1% by weight aqueous solution of aluminum chloride was added thereto and the mixture was agitated for 15 minutes while the temperature of the mixture was maintained at 20° C. In this case, the added amount of the aqueous solution of aluminum chloride is such that the weight of iron in the solution is 0.015% by weight based on the weight of the solid of the organic material dispersed therein, wherein the molar ratio of sodium to aluminum is 1/1.

Finally, a 1% by weight of an aqueous solution of sodium 3,5-di-tert-butylsalicylate was dropped into the mixture and the mixture was agitated for 1 hour while the temperature of the mixture was maintained at 20° C. In this case, the added amount of the aqueous solution of sodium 3,5-di-tert-butylsalicylate is such that the weight of 3,5-di-tert-butylsalicylic acid in the solution is 0.285% by weight based on the weight of the solid of the particles dispersed therein. The mixture was agitated for 1 hour. In addition, the charge controlling agent dispersion (1) was gradually added thereto in such an amount that the solid of zinc di-tert-butylsalicylate is 0.3% by weight based on the total weight of the particles.

Then the mixture was agitated for 1 hour at 20° C., followed by filtering. The resultant cake was dried for 24 hours at 40° C. under a reduced pressure to prepare toner particles.

Further, 100 parts of the thus prepared toner particles were mixed with 0.5 parts of a hydrophobized silica and 0.5 parts of a hydrophobized titanium, and the mixture was agitated by a HENSCHEL mixer. Thus, a toner of the present invention was prepared.

Preparation of Charge Controlling Agent Dispersion (2)

Ten (10) parts of a calixarene polymer, F-21 manufactured by Orient chemical Industries Co., Ltd., and 1 part of sodium dodecylbenzenesulfonate were mixed with 100 parts of distilled water in a ball mill pot containing zirconia balls with a diameter of 5 mm to be subjected to ball milling for 24 hours. Thus, a charge controlling agent dispersion (1) was prepared. The particle diameter of each particle of the calixarene polymer was not greater than 1 μm.

Example 6

The procedure for preparation of the toner in Example 5 was repeated except that the charge controlling agent dispersion (1) was replaced with the charge controlling agent dispersion (2). Thus, a toner of the present invention was prepared.

Preparation of Particulate Resin

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 138 parts of styrene, 83 parts of methacrylic acid, 55 parts of tetrafluoroethyl methacrylate, and 1 part of ammonium persulfate were contained and the mixture was agitated for 15 minutes at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/tetrafluoroethylene/sodium salt of sulfate of ethylene oxide adduct of methacrylic acid) was prepared.

The volume-average particle diameter of the particles in the particulate resin dispersion, which was measured by an instrument LA-920 from Horiba Ltd., was 0.25 μm.

Example 7

The procedure for preparation of the toner in Example 5 was repeated except that the charge controlling agent dispersion (1) was replaced with the particulate resin dispersion prepared above, wherein the particulate resin dispersion was gradually added such that the content of the resin particles in the resultant toner is 1.0% by weight.

Thus, a toner of the present invention was prepared.

Evaluation of Toner

Five (5) parts of each toner were mixed with 95 parts of a carrier, which had been prepared as follows, using a blender. Thus, a two-component developer was prepared.

Preparation of Carrier

A spherical ferrite having an average particle diameter of 50 μm which serves as a core material was coated with a coating liquid, which had been prepared by dispersing an aminosilane coupling agent and a silicone resin in toluene, using a spray coating method. Then the coated carrier was calcined and then cooled. Thus, a coated carrier with a resin layer having a thickness of 0.2 μm was prepared.

The toner and developer were evaluated as follows.

(1) Charge Rising Property (CRP)

One hundred (100) parts of the coated carrier and 5 parts of each of the toners prepared above were contained in a stainless pot under conditions of 20° C. in temperature and 50% in relative humidity. The pot containing the toner and the coated carrier was set on a ball mill stand to be rotated at a predetermined revolution. After the pot was rotated for 15 second, the charge quantity (units of μC/g) of the developer in the pot was determined by a blow-off method.

(2) Saturation Charge Quantity (SCQ)

The saturation charge quantity (units of μC/g) of each developer was determined in the same way as that mentioned above in numbered paragraph (1) except that the rotation was performed for 10 minutes.

(3) Saturation Charge Quantity Under High Temperature and High Humidity Condition (HH SCQ)

One hundred (100) parts of the coated carrier and 5 parts of each of the toners prepared above were allowed to settle under conditions of 30° C. and 90% RH, and the carrier and the toner were contained in a stainless pot. The pot containing the toner and the coated carrier was set on a ball mill stand to be rotated at a predetermined revolution. After the pot was rotated for 10 minutes, the high temperature/high humidity saturation charge quantity (i.e., HH SCQ, units of μC/g) of the developer in the pot was determined by the blow-off method.

(4) Fine Line Reproducibility

Each developer was set in a marketed tandem type color copier, IMAGIO COLOR 5000 from Ricoh Co., Ltd., which uses an intermediate transfer medium. The color copier was modified such that an oil supplying device supplying an oil to the fixing device is removed therefrom. Then an original image with image area proportion of 7% was repeatedly copied on sheets of a paper, TYPE 6000 from Ricoh Co., Ltd. The first image and 30,000$^{th}$ image were observed using a microscope of 100 power magnification while comparing the images with the original image to determine whether the reproduced fine lines have omissions. The qualities of the fine line images are graded into the following four ranks.

◎: excellent

○: good

Δ: slightly bad

×: seriously bad (not acceptable)

(5) Fixable Temperature Range

After the 30,000-copy running test performed above, a solid toner image was formed on entire the surface of a sheet of the paper at various fixing temperatures of from 120° C. to 200° C. Then an adhesive tape was adhered to each solid image and then the tape was peeled therefrom to determine whether the toner is transferred to the tape. The tape was observed while compared with a standard sample to determine whether the amount of the transferred toner is not greater than that of the standard sample. The lowest fixing temperature (Tmin) is the minimum of the fixing temperature range in which the amount of the toner on the tape is not greater than that of the standard sample. The maximum fixing temperature (Tmax) is defined as a fixing temperature, above which a hot offset problem is caused. The fixable temperature range is defined as (Tmax-Tmin).

The evaluation results are shown in Table 1.

TABLE 1

| | CRP (μC/g) | SCQ (μC/g) | HH SCQ (μC/g) | Fine line Reproducibility | Fixable temperature range (° C.) |
|---|---|---|---|---|---|
| Ex. 1 | −32.3 | −36.5 | −20.3 | ◎ | 60 |
| Ex. 2 | −36.2 | −40.8 | −32.5 | ◎ | 70 |
| Ex. 3 | −38.5 | −43.3 | −36.6 | ◎ | 65 |
| Ex. 4 | −31.5 | −28.5 | −21.2 | ◎ | 45 |
| Ex. 5 | −40.2 | −45.2 | −31.2 | ○ | 50 |

TABLE 1-continued

| | CRP (μC/g) | SCQ (μC/g) | HH SCQ (μC/g) | Fine line Reproducibility | Fixable temperature range (° C.) |
|---|---|---|---|---|---|
| Ex. 6 | −32.5 | −33.9 | −31.1 | ○ | 60 |
| Ex. 7 | −29.5 | −31.2 | −32.2 | ◎ | 90 |
| Comp. Ex. 1 | +7.5 | −15.2 | −10.5 | X | 70 |
| Comp. Ex. 2 | +8.1 | −15.0 | −9.6 | X | 15 |
| Comp. Ex. 3 | +10.0 | −14.5 | −12.3 | X | 45 |
| Comp. Ex. 4 | +8.6 | −12.3 | −13.3 | X | 40 |

Example 8

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Thus, an organic material composition liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then the organic material composition liquid prepared above was added thereto, and the mixture was agitated for 3 minutes to prepare an emulsion.

Then the emulsion was transferred to a flask with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation wasperformedthreetimes. Thethuspreparedcakewasdispersed again in distilled water so that the solid content is 10% by weight.

Then the following surface treatment was performed at 20° C. At first, a 1% by weight aqueous solution of sodium hydroxide was added to the dispersion and the mixture was agitated for 15 minutes. In this case, the added amount of the aqueous solution of sodium hydroxide is such that the weight of sodium in the solution is 0.087% by weight based on the weight of the solid of the organic material dispersed therein. In addition, a 1% by weight aqueous solution of aluminum chloride was added thereto and the mixture was agitated for 15 minutes. In this case, the added amount of the aqueous solution of aluminum chloride is such that the weight of aluminum in the solution is 0.010% by weight based on the weight of the solid of the organic material dispersed therein.

Further, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.190% by weight based on the weight of the solid of the organic material dispersed therein.

Then, a 1% by weight aqueous solution of aluminum chloride was added to the dispersion in such an amount that the weight of aluminum in the solution is 0.010% by weight based on the weight of the solid of the organic material dispersed therein, and the mixture was agitated for 15 minutes.

Furthermore, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.090% by weight based on the weight of the solid of the organic material dispersed therein.

Then the dispersion was filtered and the resultant cake was dried for 24 hours at 40° C. under a reduced pressure. Thus, a particulate organic material having an average particle diameter of 5.0±0.5 μm was prepared.

Example 9

At first, 200 parts of an ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the prepolymer prepared above was added thereto in such an amount that the solid of the prepolymer is 20 parts and the mixture was agitated. Thus, an organic material composition liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then a mixture (i.e., an oil phase liquid) of the organic material composition liquid prepared above and 1 part of the ketimine compound which had been added to the organic material composition liquid just before was added thereto, and the mixture was agitated for 3 minutes to prepare an emulsion.

Then the emulsion was transferred to a flask with an agitator and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight.

Then the following surface treatment was performed at 20° C. At first, a 1% by weight aqueous solution of sodium hydroxide was added to the dispersion and the mixture was agitated for 15 minutes. In this case, the added amount of the aqueous solution of sodium hydroxide is such that the weight of sodium in the solution is 0.087% by weight based on the weight of the solid of the organic material dispersed therein. In addition, a 1% by weight aqueous solution of aluminum chloride was added thereto and the mixture was agitated for 15 minutes. In this case, the added amount of the aqueous solution of aluminum chloride is such that the weight of aluminum in the solution is 0.010% by weight based on the weight of the solid of the organic material dispersed therein.

Further, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.190% by weight based on the weight of the solid of the organic material dispersed therein.

Then, a 1% by weight aqueous solution of zinc sulfate was added to the dispersion in such an amount that the weight of aluminum in the solution is 0.021% by weight based on the weight of the solid of the organic material dispersed therein, and the mixture was agitated for 15 minutes.

Furthermore, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.079% by weight based on the weight of the solid of the organic material dispersed therein.

Then the dispersion was filtered and the resultant cake was dried for 24 hours at 40° C. under a reduced pressure. Thus, a particulate organic material (i.e., a toner) having an average particle diameter of 5.0±0.5 μm was prepared.

Example 10

The procedure for preparation of the toner in Example 9 was repeated except that the surface treatment was performed as follows.

The following surface treatment was performed at 20° C. At first, a 1% by weight aqueous solution of sodium hydroxide was added to the dispersion and the mixture was agitated for 15 minutes. In this case, the added amount of the aqueous solution of sodium hydroxide is such that the weight of sodium in the solution is 0.087% by weight based on the weight of the solid of the organic material dispersed therein. In addition, a 1% by weight aqueous solution of aluminum chloride was added thereto and the mixture was agitated for 15 minutes. In this case, the added amount of the aqueous solution of aluminum chloride is such that the weight of aluminum in the solution is 0.010% by weight based on the weight of the solid of the organic material dispersed therein.

Further, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.190% by weight based on the weight of the solid of the organic material dispersed therein.

Then, a 1% by weight aqueous solution of zirconium oxychloride was added to the dispersion in such an amount that the weight of oxyzirconium in the solution is 0.030% by weight based on the weight of the solid of the organic material dispersed therein, and the mixture was agitated for 15 minutes.

Furthermore, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.070% by weight based on the weight of the solid of the organic material dispersed therein.

Then the dispersion was filtered and the resultant cake was dried for 24 hours at 40° C. under a reduced pressure. Thus, a particulate organic material (i.e., a toner) having an average particle diameter of 5.0±0.5 μm was prepared.

Comparative Example 5

The procedure for preparation of the particulate organic material in Example 8 was repeated except that the 1% by weight aqueous solution of ferric chloride was replaced with 1% by weight aqueous solution of calcium chloride which was added in such an amount that the calcium content is 0.022% by weight based on the total weight of the organic material; and the added amount of sodium 3,5-di-tert-butylsalicylate was changed from 0.285% by weight to 0.278% by weight. Thus a comparative toner was prepared.

Comparative Example 6

The procedure for preparation of the particulate organic material in Example 1 was repeated except that the added amount of the sodium hydroxide was changed from 0.013 to 0.011% by weight; the 1% by weight aqueous solution of ferric chloride was replaced with 1% by weight aqueous solution of zirconium oxychloride which was added in such an amount that the oxyzirconium content is 0.053% by weight based on the total weight of the organic material; and the added amount of sodium 3,5-di-tert-butylsalicylate was changed from 0.285% by weight to 0.247% by weight. Thus a comparative toner was prepared.

Example 11

The procedure for preparation of the toner in Example 9 was repeated except that the surface treatment was performed as follows.

The following surface treatment was performed at 20° C. At first, a 1% by weight aqueous solution of sodium hydroxide was added to the dispersion and the mixture was agitated for 15 minutes. In this case, the added amount of the aqueous solution of sodium hydroxide is such that the weight of sodium in the solution is 0.008% by weight based on the weight of the solid of the organic material dispersed therein. In addition, a 1% by weight aqueous solution of ferric chloride was added thereto and the mixture was agitated for 15 minutes. In this case, the added amount of the aqueous solution of ferric chloride is such that the weight of iron in the solution is 0.020% by weight based on the weight of the solid of the organic material dispersed therein.

Further, a 1% by weight aqueous. solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butyl-salicylic acid in the solution is 0.180% by weight based on the weight of the solid of the organic material dispersed therein.

Then, a 1% by weight aqueous solution of zirconium oxychloride was added to the dispersion in such an amount that the weight of oxyzirconium in the solution is 0.030% by weight based on the weight of the solid of the organic material dispersed therein, and the mixture was agitated for 15 minutes.

Furthermore, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.070% by weight based on the weight of the solid of the organic material dispersed therein.

Then the dispersion was filtered and the resultant cake was dried for 24 hours at 40° C. under a reduced pressure. Thus, a particulate organic material (i.e., a toner) having an average particle diameter of 5.0±0.5 μm was prepared.

Example 12

The procedure for preparation of the toner in Example 9 was repeated except that the surface treatment was performed as follows.

The following surface treatment was performed at 20° C. At first, a 1% by weight aqueous solution of sodium hydroxide was added to the dispersion and the mixture was agitated for 15 minutes. In this case, the added amount of the aqueous solution of sodium hydroxide is such that the weight of sodium in the solution is 0.008% by weight based on the weight of the solid of the organic material dispersed therein. In addition, a 1% by weight aqueous solution of chromium sulfate was added thereto and the mixture was agitated for 15 minutes. In this case, the added amount of the aqueous solution of chromium sulfate is such that the weight of chromium in the solution is 0.019% by weight based on the weight of the solid of the organic material dispersed therein.

Further, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.181% by weight based on the weight of the solid of the organic material dispersed therein.

Then, a 1% by weight aqueous solution of zirconium oxychloride was added to the dispersion in such an amount that the weight of oxyzirconium in the solution is 0.030% by weight based on the weight of the solid of the organic material dispersed therein, and the mixture was agitated for 15 minutes.

Furthermore, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.070% by weight based on the weight of the solid of the organic material dispersed therein.

Then the dispersion was filtered and the resultant cake was dried for 24 hours at 40° C. under a reduced pressure. Thus, a particulate organic material (i.e., a toner) having an average particle diameter of 5.0±0.5 μm was prepared.

Example 13

The procedure for preparation of the toner in Example 9 was repeated except that the surface treatment was performed as follows.

The following surface treatment was performed at 20° C. At first, a 1% by weight aqueous solution of sodium hydroxide was added to the dispersion and the mixture was agitated for 15 minutes. In this case, the added amount of the aqueous solution of sodium hydroxide is such that the weight of sodium in the solution is 0.087% by weight based on the weight of the solid of the organic material dispersed therein. In addition, a 1% by weight aqueous solution of aluminum chloride was added thereto and the mixture was agitated for 15 minutes. In this case, the added amount of the aqueous solution of aluminum chloride is such that the weight of aluminum in the solution is 0.010% by weight based on the weight of the solid of the organic material dispersed therein.

Further, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.190% by weight based on the weight of the solid of the organic material dispersed therein.

Then, a 1% by weight aqueous solution of aluminum chloride was added to the dispersion in such an amount that the weight of aluminum in the solution is 0.010% by weight based on the weight of the solid of the organic material dispersed therein, and the mixture was agitated for 15 minutes.

Furthermore, a 1% by weight aqueous solution of sodium 3,5-di-tert-butylsalicylate was dropped into the mixture while the mixture was agitated for 1 hour. In this case, the added amount of the aqueous solution of sodium 3,5-di-tert-butylsalicylate is such that the weight of 3,5-di-tert-butylsalicylic acid in the solution is 0.090% by weight based on the weight of the solid of the organic material dispersed therein.

In addition, a 1% by weight aqueous solution of N,N,N-trimethyl-[3-(4-perfluorononenyloxybenzaminde)propyl] ammonium (FUTARGENT 310 from Neos) was gradually added to the dispersion in such an amount of 0.3% by weight on a dry basis based on the weight of the solid of the organic material dispersed therein. Then the dispersion was agitated for one hour.

The dispersion was filtered and the resultant cake was dried for 24 hours at 40° C. under a reduced pressure. Thus, a particulate organic material (i.e., a toner) having an average particle diameter of 5.0±0.5 μm was prepared.

Example 14

The procedure for preparation of the toner in Example 13 was repeated except that FUTARGENT 310 was replaced with the charge controlling agent dispersion (2). Thus, a toner of the present invention was prepared.

Example 15

The procedure for preparation of the toner in Example 13 was repeated except that the charge controlling agent dispersion (1) was replaced with the particulate resin dispersion prepared above, wherein the particulate resin dispersion was gradually added such that the content of the resin particles in the resultant toner is 1.0% by weight.

Thus, a toner of the present invention was prepared.

Each of the toners prepared in Examples 8 to 15 and Comparative Examples 5 and 6 was evaluated in the same way as performed in Example 1. The results are shown in Table 2.

TABLE 2

| | CRP (μC/g) | SCQ (μC/g) | HH SCQ (μC/g) | Fine line Reproducibility | Fixable temperature range (° C.) |
|---|---|---|---|---|---|
| Ex. 8 | −33.0 | −35.5 | −32.3 | ◎ | 75 |
| Ex. 9 | −36.2 | −40.2 | −33.5 | ◎ | 75 |
| Ex. 10 | −32.5 | −36.3 | −34.6 | ◎ | 65 |
| Ex. 11 | −31.5 | −38.5 | −33.2 | ◎ | 85 |
| Ex. 12 | −37.2 | −40.8 | −36.2 | ◎ | 80 |
| Ex. 13 | −35.5 | −36.9 | −28.1 | ◎ | 50 |
| Ex. 14 | −36.5 | −37.2 | −32.2 | ○ | 60 |
| Ex. 15 | −32.5 | −35.2 | −27.2 | ○ | 55 |
| Comp. Ex. 35 | +10.0 | −14.5 | −12.3 | X | 45 |
| Comp. Ex. 6 | +8.6 | −12.3 | −13.3 | X | 40 |

The method of the present invention for preparing a functional particulate organic material can be used not only for the electrophotographic toner but also paints, colorants, fluidity improving agents, spacers, preservation stabilizers, cosmetics, fluorescent labels and the like materials.

Effects of the Present Invention

By using the surface treatment method mentioned above, a variety of surface modifying agents can be easily fixed firmly on a surface of organic particles without causing problems such as morphologic alteration caused by heat and mechanical shocks. Therefore, a desired function can be imparted to the organic particles.

When the surface treatment method is used for an electrophotographic toner, the resultant toner has good charge properties (i.e., is excellent in charge rising property, saturation charge quantity and high temperature/high humidity saturation charge quantity), and thereby high quality images (such as high definition images) can be produced. In addition, the resultant toner does not cause a problem in that by performing a surface treatment, the lowest fixable temperature increases, which problem is specific to conventional surface treatments.

Namely, in the functional particulate organic material (such as toner) of the present invention, functional organic molecules can be selectively present on the surface of the organic material, and thereby good functions (such as charge properties) can be efficiently imparted to the organic material. This is difficult when using conventional techniques.

This document claims priority and contains subject matter related to Japanese Patent Applications Nos. 2003-178465, 2003-406818 and 2003-406821, filed on Jun. 23, 2003, Dec. 5, 2003 and Dec. 5, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by letters patent of the united states is:

1. A toner composition comprising:

one or more toner particles comprising:

a colorant; and a binder resin having an acid group, and a fluidity improving agent, wherein the one or more toner particles have multiple layers on a surface thereof comprising:

a first layer comprising a tri- or more-valent metal cation bonded to the acid group of the binder resin and at least one of two or more reaction groups of an organic acid or an organic acid salt; and at least one additional layer comprising a di- or more-valent metal cation bonded to another one of the two or more reaction groups of the organic acid or the organic acid salt and at least one of two or more reaction groups of an additional organic acid or an additional organic acid salt, which are the same as or different from the organic acid or the organic acid salt.

2. The toner composition according to claim 1, wherein the one or more toner particles are prepared by a method comprising:

providing a suspension of a particulate material including the colorant and the binder resin;

first reacting the acid group of the binder resin with the tri- or more-valent metal cation;

second reacting the tri- or more-valent metal cation with at least one of two or more reaction groups of the organic acid or the organic acid salt;

third reacting another one of the two or more reaction groups of the organic acid or the organic acid salt with the di- or more-valent metal cation;

fourth reacting the di- or more-valent metal cation with at least one of two or more reaction groups of the additional organic acid or the additional organic acid salt, which are the same as or different from the organic acid or the organic acid salt;

drying the suspension to prepare the one or more toner particles; and mixing the fluidity improving agent with the one or more toner particles.

3. The toner composition according to claim 1, wherein the binder resin comprises a polyester resin in an amount of from 50 to 100% by weight based on total weight of the binder resin.

4. The toner composition according to claim 1, wherein the binder resin comprises a polyester resin having a terminal isocyanate group.

5. The toner composition according to claim 1, wherein the binder resin comprises a polyester resin having urea bonding and urethane bonding.

6. The toner composition according to claim 1, wherein the organic acid or the additional organic acid is represented by the following general formula (1):

(1)

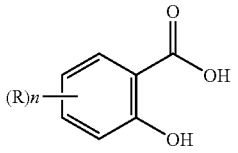

or a salt thereof wherein n is an integer of from 1 to 4, and R represents an alkyl group having from 1 to 12 carbon atoms, an aryl group, a perfluoroalkyl group, a nitro group, a halogen group or an amino group, and wherein each R may be the same or different when n is 2 or more.

7. The toner composition according to claim 1, wherein the organic acid or the additional organic acid is represented by the following general formula (2):

(2)

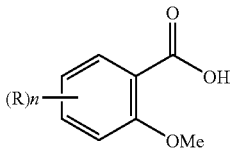

or a salt thereof wherein n is an integer of from 1 to 4, and R represents an alkyl group having from 1 to 12 carbon atoms, an aryl group, a perfluoroalkyl group, a nitro group, a halogen group or an amino group, and wherein each R may be the same or different when n is 2 or more.

8. The toner composition according to claim 1, wherein the organic acid or the additional organic acid is represented by the following general formula (3):

(3)

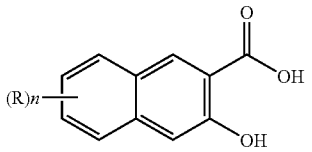

or a salt thereof wherein n is an integer of from 1 to 4, and R represents an alkyl group having from 1 to 12 carbon atoms, an aryl group, a perfluoroalkyl group, a nitro group, a halogen group or an amino group, and wherein each R may be the same or different when n is 2 or more.

9. The toner composition according to claim 1, wherein the organic acid or the additional organic acid is salicylic acid or a salt thereof.

10. The toner composition according to claim 1, wherein the organic acid or the additional organic acid is 3,5-di-tert-butylsalicylic acid or a salt thereof.

11. The toner composition according to claim 1, wherein the organic acid or the additional organic acid is benzylic acid or a salt thereof.

12. The toner composition according to claim 1, wherein the tri- or more-valent metal cation is a metal selected from the group consisting of Fe, Al, Cr, Co, Ga, Zr, Si and Ti.

13. The toner composition according to claim 1, wherein the tri- or more-valent metal cation is a metal selected from the group consisting of Fe, Co, Ga, Zr, Si and Ti.

14. The toner composition according to claim 1, wherein the di- or more-valent metal cation is a metal selected from the group consisting of Ca, Zn, Fe, Al, Cr, Co, Ga, Zr, Si and Ti.

15. The toner composition according to claim 1, wherein the di- or more-valent metal cation is a metal selected from the group consisting of Ca, Zn, Fe, Co, Ga, Zr, Si and Ti.

16. The toner composition according to claim 1, wherein the fluidity improving agent is an inorganic particulate material selected from silica, alumina, titanium oxide, barium titanate, magnesium titanate, calcium titanate, strontium titanate, zinc oxide, tin oxide, quartz sand, clay, mica, sand-lime, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

17. The toner composition according to claim 16, wherein the fluidity improving agent is an inorganic particulate material having a primary particle diameter of from 5 nm to 2 μm.

18. The toner composition according to claim 16, wherein the fluidity improving agent is an inorganic particulate material having a primary particle diameter of from 5 nm to 500 nm.

19. The toner composition according to claim 16, wherein the fluidity improving agent is an inorganic particulate material having a surface area of from 20 $m^2/g$ to 500 $m^2/g$ as determined by BET.

* * * * *